US010946427B2

(12) United States Patent
Miyagi et al.

(10) Patent No.: US 10,946,427 B2
(45) Date of Patent: Mar. 16, 2021

(54) BLANK, FORMING PLATE, PRESS FORMED ARTICLE MANUFACTURING METHOD, AND PRESS FORMED ARTICLE

(71) Applicant: NIPPON STEEL & SUMITOMO METAL CORPORATION, Tokyo (JP)

(72) Inventors: Takashi Miyagi, Tokyo (JP); Kei Misawa, Tokyo (JP); Yasuharu Tanaka, Tokyo (JP); Misao Ogawa, Tokyo (JP); Toshimitsu Aso, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 701 days.

(21) Appl. No.: 14/890,227

(22) PCT Filed: May 13, 2014

(86) PCT No.: PCT/JP2014/062750
§ 371 (c)(1),
(2) Date: Nov. 10, 2015

(87) PCT Pub. No.: WO2014/185428
PCT Pub. Date: Nov. 20, 2014

(65) Prior Publication Data

US 2016/0082495 A1 Mar. 24, 2016

(30) Foreign Application Priority Data

May 13, 2013 (JP) ..... JP2013-101419

(51) Int. Cl.
*B21D 22/02* (2006.01)
*B21D 53/88* (2006.01)
(Continued)

(52) U.S. Cl.
CPC ..... *B21D 22/02* (2013.01); *B21D 22/22* (2013.01); *B21D 22/26* (2013.01); *B21D 53/88* (2013.01)

(58) Field of Classification Search
CPC ..... B21D 22/02; B21D 22/22; B21D 22/26; B21D 53/88; B21K 23/04; Y10T 29/49995–49996; Y10T 29/49622
See application file for complete search history.

(56) References Cited

U.S. PATENT DOCUMENTS

2006/0207212 A1* 9/2006 Durney ..... E04B 2/78 52/846
2012/0297853 A1 11/2012 Tanaka et al.
2013/0239645 A1 9/2013 Tanaka et al.

FOREIGN PATENT DOCUMENTS

CN 102791396 A 11/2012
EP 2116322 B1 * 1/2012 ..... B23K 33/008
(Continued)

OTHER PUBLICATIONS

Hero's Products Inc., "(1) Blank "Black" Aluminum License Plates 6"×12"" Amazon.com, pp. 1-12 (Year: 2012).*
(Continued)

*Primary Examiner* — Maria V Ewald
*Assistant Examiner* — Ethan Weydemeyer
(74) *Attorney, Agent, or Firm* — Birch, Stewart, Kolasch & Birch, LLP.

(57) ABSTRACT

A blank that is a material for an elongated press formed article having a substantially hat shaped lateral cross-section profile including a top plate section, a ridge line section, a flange section, and vertical wall section, and configured with a first portion in which the top plate section has a fixed width, and a second portion including a curved portion in which the top plate section exhibits an L-shape in plan view due to the vertical wall section, the ridge line section, and the
(Continued)

flange section curving along with the width of the top plate section gradually increasing. The blank has a shape of an opened-out shape of the press formed article, additionally with a first recess, a protrusion, and a second recess provided to an edge of an excess portion additionally provided at an edge of a location that will form the flange section configuring the curved portion.

13 Claims, 24 Drawing Sheets

(51) Int. Cl.
*B21D 22/22* (2006.01)
*B21D 22/26* (2006.01)

(56) References Cited

FOREIGN PATENT DOCUMENTS

| | | | |
|---|---|---|---|
| JP | 64-66024 | A | 3/1989 |
| JP | 07-290159 | | 11/1995 |
| JP | 08-103828 | | 4/1996 |
| JP | 2551022 | B2 | 11/1996 |
| JP | 2003-103306 | | 4/2003 |
| JP | 2004-154859 | | 6/2004 |
| JP | 2006-015404 | | 1/2006 |
| JP | 2008-307557 | | 12/2008 |
| JP | 2010-036217 | | 2/2010 |
| JP | 2013-35068 | A | 2/2013 |
| JP | 5161214 | | 3/2013 |
| JP | 5168429 | | 3/2013 |
| KR | 10-2012-0140236 | A | 12/2012 |
| TW | 201206585 | A | 2/2012 |
| WO | 2011/145679 | | 11/2011 |
| WO | 2012/070623 | | 5/2012 |

OTHER PUBLICATIONS

Masashi et al, Manufacture of deep drawing product having arc-state recessed part (English Translation), JPO, pp. 1-4, Published Apr. 28, 1994.*

"Logopress3 Blank," SOLIDWORKS Partners, Aug. 17, 2011, SOLIDWORKS Partners (via Youtube), See Timestamp 1:52 and 1:56, found at the URL "https://www.youtube.com/watch?v=iC_wT97ylhc" (Year: 2011).*

European Search Report dated Oct. 19, 2015 in corresponding EP patent application No. 13758164.1.

Office Action dated Sep. 1, 2015 in corresponding Korean Application No. 10-2014-7024146.

Extended European Search Report for European Application No. 14797040.4, dated Dec. 12, 2016.

Korean Notice of Submission of Opinion for Korean Application No. 10-2015-7033546, dated Nov. 22, 2016, with a partial English translation.

"An Analysis of Non-Uniform Stretch Flanging of Sheet Metal by Yasutomo Nagai," Plasticity and Processing, Journal of Japan Plastic Processing Association, vol. 24, No. 266, publ. Mar. 20, 1983, pp. 247-253 and 300, with English translation (21 pages total).

"Measures against Stretch Flange Cracking of High Tensile Steel Sheet Using In-Plane Residual Thickness," Plasticity Processing Spring Lecture Conference Papers, May 27-29, 2011 (publ. May 13, 2011), pp. 357-358, with English translation (8 pages total).

"Preventing Crack by Stretch Flanging of High Tensile Strength Steel Sheet with Additional Part," Materials and Processes, CAMP-ISIJ, vol. 24, No. 1, Mar. 1, 2011, p. 176, with English translation (5 pages total).

"Stretch Flange Characteristics of Ultra High Strength Steel Sheet (2nd Report)—Examination of Elongation Flange Crack Prevention Technique by In-Plane Excessive Blank," Plasticity Processing Spring Lecture Conference Papers, May 9, 2008, pp. 281-282, with English translation (8 pages total).

Office Action dated Jan. 26, 2016 in corresponding Taiwanese Application No. 103116927.

Canadian Office Action for corresponding Canadian Application No. 2,912,041, dated May 1, 2017.

Search Report dated Jun. 17, 2014 issued in corresponding International Application No. PCT/JP2014/062750.

Indian Office Action for corresponding Indian Application No. 11037/DELNP/2015, dated Mar. 11, 2019, with English translation.

Chinese Office Action and partial English translation thereof, dated Jun. 1, 2016, for corresponding Chinese Application No. 201480025431.1.

* cited by examiner

BLANK, FORMING PLATE, PRESS FORMED ARTICLE MANUFACTURING METHOD, AND PRESS FORMED ARTICLE

CROSS-REFERENCE TO RELATED APPLICATIONS

This application is a national stage application of International Application No. PCT/JP2014/062750, filed May 13, 2014, which is incorporated herein by reference in its entirety, and which claims priority to Japanese Patent Application No. 2013-101419, filed on May 13, 2013.

TECHNICAL FIELD

The present invention relates to a blank, a forming plate, a manufacturing method for a press formed article, and a press formed article.

BACKGROUND ART

Automotive body shells include unit construction structures (monocoque structures) in which framework members such as front pillars, center pillars, side sills, roof rails, side members and the like, are joined together with various formed panels such as hood ridges, dash panels, front floor panels, rear floor front panels, and rear floor rear panels. Framework members that generally have a closed cross-section, such as front pillars, center pillars, and side sills, are assembled by joining configuration members such as front pillar reinforcement, center pillar reinforcement, and side sill outer reinforcement, to other configuration members such as outer panels and inner panels.

For example, as illustrated in FIG. 12, a framework member 1 is formed by joining configuration members 2 to 5 together by spot welding.

The configuration member 2 has a substantially hat shaped lateral cross-section profile including a top plate section 2*a*, a pair of vertical wall sections 2*b*, 2*b* extending downward from either end of the top plate section 2*a*, and flange sections 2*c*, 2*c* extending outward from lower ends of the vertical wall sections 2*b*, 2*b*. The top plate section 2*a* of the structural member 2 has an L-shaped external profile in plan view (such a configuration member is also referred to below as an "L-shaped profile component"). The strength and rigidity of the framework member 1 are secured by including such a configuration member 2.

FIG. 13 is an explanatory diagram illustrating a configuration member (also sometimes referred to below as a "T-shaped profile component") 6 including a top plate section 6*a* that has a T-shaped external profile in plan view. Similarly to the L-shaped profile component 2, the T-shaped profile component 6 also has a substantially hat shaped lateral cross-section profile including the top plate section 6*a*, a pair of left and right vertical wall sections 6*b*, 6*b*, and flange sections 6*c*, 6*c*. There are also Y-shaped profile components (not illustrated in the drawings), in which the T-shaped profile component 6 has been modified so as to give the top plate section a Y-shaped external profile in plan view.

Pressing by drawing is normally employed when manufacturing the L-shaped profile component 2, the T-shaped profile component 6, or the Y-shaped profile component by pressing, in order to suppress creasing from occurring.

FIG. 14A is a schematic explanatory diagram illustrating pressing by drawing at a stage prior to the start of forming, and FIG. 14B is a schematic explanatory diagram illustrating forming completion.

In a drawing method, as illustrated in FIG. 14A and FIG. 14B, a die 7, a punch 8, and a crease suppresser 9 (blank holder) are employed to press material of a metal plate (a blank) 10 into a press formed article, for example an L-shaped profile component 11, by drawing.

FIG. 15 is a schematic explanatory diagram illustrating an example of the press formed article 11 manufactured by pressing using drawing, and FIG. 16 is a schematic explanatory diagram illustrating the blank 10 that is the forming material of the press formed article 11. FIG. 17 is a schematic explanatory diagram in which a crease suppression region 10*a* of the blank 10 is illustrated by hatching, and FIG. 18 is a schematic explanatory diagram illustrating an intermediate press formed article 12 prior to trimming.

For example, in cases in which the L-shaped profile component 11 illustrated in FIG. 15 is manufactured by a pressing method using drawing, (1) the plate metal material 10 illustrated in FIG. 16 is placed between the die 7 and the punch 8 illustrated in FIG. 14A, (2) the crease suppression region 10*a* surrounding the plate metal material 10 as illustrated in FIG. 17 is held firmly in place by the crease suppresser 9 and the die 7, (3) as illustrated in FIG. 14B, the die 7 and the punch 8 are moved relative to each other in the pressing direction (the vertical direction) and the plate metal material 10 is pressed into the intermediate press formed article 12 illustrated in FIG. 18 by drawing, and (4) unwanted portions surrounding the intermediate press formed article 12 are trimmed, so as to obtain the L-shaped profile component 11.

As illustrated in FIG. 14A, FIG. 14B, and FIG. 15 to FIG. 18, by pressing forming by drawing, inflow of the blank 10 into the mold can be suppressed by the crease suppresser 9, thereby enabling the occurrence of creasing due to excessive inflow of the blank 10 to be suppressed in the intermediate press formed article 12.

However, in order to manufacture the press formed article 11 by pressing forming by drawing, a broad trim region is required surrounding the intermediate press formed article 12, thereby reducing the yield of the press formed article 11 and increasing the manufacturing cost.

FIG. 19 is a schematic explanatory diagram illustrating examples of conditions under which the pressing defects of creasing and cracking occur in the intermediate press formed article 12.

As illustrated in FIG. 19, in the intermediate press formed article 12, creasing is liable to occur at regions $\alpha$ where there is excessive inflow of the blank 10 into the mold during the drawing process, and cracking is liable to occur at regions $\beta$ where there is localized reduction in plate thickness during the drawing process. In particular, when pressing is attempted by drawing the L-shaped profile component 2 using a high strength steel plate with low ductility as a blank, creasing and cracking are liable to occur due to insufficient ductility of the blank 10.

In order to prevent the occurrence of such creasing and cracking, conventionally a steel plate that has excellent ductility but comparatively low strength has been employed as the blank 10 for the L-shaped profile component 2, such as front pillar reinforcement or the like, or for the T-shaped profile component 6, such as center pillar reinforcement or the like. It has accordingly been necessary to increase plate thickness of the blank 10 in order to secure strength, making an increase in weight and an increase in cost unavoidable.

Japanese Patent Application Laid-Open (JP-A) Nos. 2003-103306, 2004-154859, 2006-015404, and 2008-307557 (also referred to below as "Patent Documents 1 to 4" respectively) describe pressing methods using bending to manufacture components with a simple cross-section profile such as a hat shaped or a Z-shaped profile extending along the entire length in the length direction. However, these methods are not applicable to manufacture of products with complex profiles such as the L-shaped profile component 2, the T-shaped profile component 6, or a Y-shaped profile component.

Accordingly, in pamphlet of International Publication No. 2011/145679 (also referred to below as "Patent Document 5"), the present inventors have previously disclosed a patented invention (specification of Japanese Patent No. 5168429) relating to a method that enables the L-shaped profile component 2, the T-shaped profile component 6, or a Y-shaped profile component to be pressed by bending with good yield, and without creasing or cracking occurring, even when a high tensile steel plate with low ductility is employed for the blank.

Since this patented invention is already known from Patent Document 5, it is explained in brief below. This patented invention is a method to form, from a blank, a component having a substantially hat shaped lateral cross-section profile and a vertical wall section including a bent portion forming a protrusion toward a top plate section side in plan view, such as an L-shaped profile member. A blank is placed between a die, and a pad and a bending mold, and (1) in a state in which the pad applies pressure to a portion of a location of the blank corresponding to the top plate section and serving as an out-of-plane deformation suppression region, and also in a state in which an end portion of a portion of the blank corresponding to the L-shape lower side is present in the same plane as the top plate section, moving the die and the bending mold relative to each other in a vertical direction so as to form an L-shaped profile component by forming a vertical wall section and a flange section while sliding (moving in-plane) the end portion of the portion of the blank corresponding to the L-shape lower side over a location of the die corresponding to the top plate section. Alternatively, (2) the pad is placed in the vicinity or in contact with a portion of the location of the blank corresponding to the top plate section and serving as an out-of-plane deformation suppression region, and in a state in which a gap between the pad and the die is maintained at from the plate thickness of the blank to 1.1 times the plate thickness of the blank, and also in a state in which the end portion of the blank at the portion corresponding to the L-shape lower side is present in the same plane as the top plate section, moving the die and the bending mold relative to each other in a vertical direction so as to form the L-shaped profile component by forming a vertical wall section and a flange section while sliding (moving in-plane) the end portion of the blank at the portion corresponding to the L-shape lower side over the location of the die corresponding to the top plate section of the blank. In the present specification, the method of pressing by bending according to this patented invention is referred to as a "free bending method".

In the free bending method, in order to press an L-shaped profile component or the like from a blank, a location of the blank corresponding to a portion at the L-shape lower side of the L-shaped profile component is pulled toward the vertical wall section. As a result, cracking is suppressed due to being able to reduce excessive tensional stress at the flange section, which is vulnerable to cracking due to a reduction in plate thickness when pressing by ordinary drawing.

Moreover, even at the top plate section where creasing is likely to occur due to excessive inflow of the blank during pressing by normal drawing of the L-shaped profile component, creasing that occurs due to inflow of the blank is suppressed.

Moreover, yield is improved since there is no need to provide a large trim region to suppress creasing, such as is always provided at a location of the blank corresponding to a portion at the L-shape lower side of the L-shaped profile component when pressing by normal drawing.

Moreover, since the ductility demanded of the blank for pressing by bending is reduced, it is possible to employ a steel plate with comparatively low ductility and high strength for the blank, as well as a steel plate with excellent ductility and comparatively low strength. This thereby enables a reduction in the plate thickness of the blank, enabling a contribution to be made to reducing the weight of a vehicle or the like.

SUMMARY OF INVENTION

Technical Problem

As described above, a free bending method is a groundbreaking pressing method that enables cold pressing of L-shaped profile components, T-shaped profile components, or the like from high strength blanks, at low cost and without cracking and creasing occurring.

However, as a result of careful investigation by the inventors in order to further improve on the excellent pressing characteristics of the free bending method, new issues particular to the free bending method have been discovered, namely that when each of the dimensions of the L-shaped profile component 11, and especially the width w3 of the L-shape base section of a top plate section 11*a* (see FIG. 15), are long, even using the free bending method, cracking occurs at the inside or at edge portions of the L-shaped profile component 11 (at the vicinity of portion A in FIG. 15) at a portion connecting between a vertical wall section 11*b* and a flange section 11*c* in a curved portion 14 (also sometimes referred to below as "flange cracking"), and edge cracking occurs at an L-shape base section of the top plate section 11*a* (the portion B in FIG. 15) (also sometimes referred to below as "top plate edge cracking").

As a countermeasure against cracking when pressing using the free bending method, consideration might be given to, similarly to in other pressing methods that employ bending, preventing cracking by providing an excess portion of an appropriate size at the edge of a portion of the blank 10 that will form the flange section 11*c*, thereby letting the material of the top plate section 11*a* move toward the vertical wall section 11*b* side.

However, a further issue was uncovered as a result of the inventors' investigations. Namely, in order to relieve flange cracking in the free bending method, it is undoubtedly effective to provide an excess portion and increase the range at the edge of the blank 10 at the portion that will form the flange section 11*c*. However, it was discovered that since the strength of the portion that will form the flange section 11*c* where the excess portion is provided also increases, the amount of inflow of the blank from the portion of the blank 10 that will form the top plate section 11*a* to the portion of the blank 10 that will form the vertical wall section 11*b* increases, leading to the top plate edge cracking.

If, in order to avoid top plate edge cracking, an excess portion is provided to the portion of the blank 10 that will form the L-shape base section of the top plate section 11*a*, then the amount of inflow of the blank from the top plate section 11*a* to the vertical wall section 11*b* becomes insufficient due to increased deformation resistance of the top plate section 11*a*, leading to flange cracking.

Paragraph 0058 of Patent Document 5 refers to providing an excess portion of from 25 mm to 100 mm in cases in which the width of the flange section is less than 25 mm. However, there is no specific detail regarding the shape of the excess portion. There is also no description of providing an excess portion in cases in which the width of the flange section is from 25 mm to 100 mm.

Accordingly, there are no established techniques for preventing the occurrence of flange cracking or top plate edge cracking when using the free bending method to press an L-shaped profile component, a T-shaped profile component, or moreover a Y-shaped profile component in which the width w3 at one length direction end of the top plate section 11*a* is greater than the width w1 at the other end due to the presence of the curved portion 14. Accordingly, for example, when pressing using the free bending method to manufacture center pillar reinforcement, this being a typical example of a T-shaped profile component, the width of one length direction end has to be shortened (the difference in width to the other end has to be reduced) in order to prevent flange cracking and top plate edge cracking from occurring. Accordingly, it has not been possible to set the width of one length direction end of the top plate section of center pillar reinforcement longer than 300 mm with press forming technology.

An object of the present invention is to provide a blank and a forming plate that prevent or suppress creasing and cracking during pressing, a press formed article manufacturing method that prevents or suppresses creasing and cracking during pressing, and a press formed article in which creasing and cracking have been prevented from occurring.

Solution to Problem

Briefly stated, the present invention is based on the technological concept of "suppressing excessive inflow of the blank from a top plate section to a vertical wall section so as to enable top plate edge cracking to be prevented from occurring, while preventing flange cracking from occurring in the press formed article by devising a way to provide an excess portion to an edge portion of a portion that will form a flange section in a blank with an opened-out shape of a press formed article of an L-shaped profile component, a T-shaped profile component, or moreover a Y-shaped profile component". More specifically, the present invention is based on the technological concept of "providing an excess portion to an edge portion of a portion that will form a flange section in a blank with an opened-out shape of a press formed article of a T-shaped profile component, an L-shaped profile component, or moreover a Y-shaped profile component, and also providing a first recess, a protrusion, and a second recess to an edge portion of the excess portion, thereby enabling the occurrence of flange cracking to be suppressed by the protrusion provided to the excess portion, and enabling top plate edge cracking to be suppressed from occurring due to being able to reduce the amount of displacement from the top plate section to the vertical wall section by straightening out of both the first recess and the second recess provided to the excess portion".

A first aspect of the present invention provides a flat plate shaped blank for pressing to manufacture a worked component, the worked component including: a top plate section including, out of a pair of outer edge portions, at least one outer edge portion that has, in plan view, a straight-line outer edge portion of a straight line and a curved-line outer edge portion that is contiguous to the straight-line outer edge portion and that curves in a concave shape so as to move away from the other outer edge portion toward the outside; a vertical wall section including a flat vertical wall portion that is bent downward from the outer edge portion and that is formed following the straight-line outer edge portion, and a curved vertical wall portion that is formed following the curved-line outer edge portion; and a flange section including a straight-line flange portion that extends from the flat vertical wall portion toward the outside, and that is formed following the straight-line outer edge portion, and a curved-line flange portion that is formed following the curved-line outer edge portion and that extends from the curved vertical wall portion toward the outside. The blank includes: an excess portion provided at a location corresponding to an edge of the flange section in an opened-out shape of the worked component, with the excess portion formed with a protrusion forming a protruding shape toward the outside and a first recess and a second recess respectively forming recess shapes on either side of the protrusion, wherein at least the protrusion is provided at a location corresponding to an edge of the curved-line flange portion.

A second aspect of the present invention provides the blank of the first aspect of the present invention, wherein the excess portion further includes a straight-line portion forming a straight line in plan view at least one out of between the first recess and the protrusion, or between the protrusion and the second recess.

A third aspect of the present invention provides a forming plate including the blank of either the first aspect of the second aspect of the present invention, on which preprocessing has been performed prior to pressing.

A fourth aspect of the present invention provides a manufacturing method for a press formed article, the manufacturing method including: a process of placing the blank of either the first aspect of the second aspect, or the forming plate of the third aspect, of the present invention between a die, and a pad and a bending mold; and in a state in which a portion of the blank, or of the forming plate, that will form an end portion of the top plate section, the vertical wall section, and the flange section is present in the same plane as a portion of the blank, or of the forming plate, that will form the top plate section, a process of pressing by bending the vertical wall section and the flange section while moving the end portion in-plane with respect to a location of the die corresponding to the top plate section, by relatively moving either the die or the bending mold in a direction so as to approach each other in a state in which an out-of-plane deformation suppression region that is part of a portion of the blank, or of the forming plate, that will form the top plate section is being applied with pressure by the pad.

A fifth aspect of the present invention provides a manufacturing method for a press formed article, the manufacturing method including: a process of placing the blank of either the first aspect of the second aspect, or the forming plate of the third aspect, of the present invention, between a die, and a pad and a bending mold; and in a state in which a portion of the blank, or of the forming plate, that will form an end portion of the top plate section, the vertical wall section, and the flange section, is present in the same plane as a portion of the blank, or of the forming plate, that will form the top plate section, a process of pressing by bending the vertical wall section and the flange section by placing the pad in the vicinity of, or in contact with, an out-of-plane deformation suppression region that is part of a portion of the blank, or of the forming plate, that will form the top plate section, and relatively moving either the die, or the bending mold, in a direction so as to approach each other while maintaining a gap between the pad and the die of from the plate thickness to 1.1 times the plate thickness of the blank, or of the forming plate.

A sixth aspect of the present invention provides the press formed article manufacturing method of either the fourth aspect or the fifth aspect of the present invention, wherein, in plan view of the blank or the forming plate, the out-of-plane deformation suppression region is a region that is on the side of a location that will form the curved-line outer edge portion from out of regions of the portion that will form the top plate section divided into two by an extension line of a line that will form the straight-line outer edge portion, and that is a region that contacts the die.

A seventh aspect of the present invention provides the press formed article manufacturing method of any one of the fourth aspect to the sixth aspect of the present invention, wherein a portion that is an end portion of the blank, or of the forming plate, and that is present further toward a side that will form the top plate section than the curved-line outer edge portion out of locations corresponding to the out-of-plane deformation suppression region of the blank, or of the forming plate, is present in the same plane as a portion that will form the top plate section.

An eighth aspect of the present invention provides the press formed article manufacturing method of any one of the fourth aspect to the seventh aspect of the present invention, wherein the height of the vertical wall section is either 0.2 times the length of the curved-line outer edge portion or greater, or 20 mm or greater.

A ninth aspect of the present invention provides the press formed article manufacturing method of any one of the fourth aspect to the eighth aspect of the present invention, wherein the vertical wall section and the flange section are formed by placing the pad in the vicinity of, or in contact with, a region that is inside a portion of the blank, or of the forming plate, that will form the top plate section, and that is a region that extends up to at least 5 mm from the curved-line outer edge portion toward the side that will form the top plate section.

A tenth aspect of the present invention provides the press formed article manufacturing method of any one of the fourth aspect to the ninth aspect of the present invention, wherein the width of the flange section, from a central position of the curved-line outer edge portion to a position separated by 50 mm or greater from an end portion of the curved-line outer edge portion toward the straight-line outer edge portion side is from 25 mm to 100 mm.

An eleventh aspect of the present invention provides the press formed article manufacturing method of any one of the fourth aspect to the tenth aspect of the present invention, wherein the maximum radius of curvature of the curved-line outer edge portion of the top plate section is from 5 mm to 300 mm.

A twelfth aspect of the present invention provides the press formed article manufacturing method of any one of the fourth aspect to the eleventh aspect of the present invention, wherein the tensile strength of the blank, or of the forming plate, is from 400 MPa to 1600 MPa.

A thirteenth aspect of the present invention provides a press formed article including: a top plate section including, out of a pair of outer edge portions, at least one outer edge portion that has, in plan view, a straight-line outer edge portion of a straight line and a curved-line outer edge portion that is contiguous to the straight-line outer edge portion and that curves in a concave shape so as to move away from the other outer edge portion toward the outside; a vertical wall section including a flat vertical wall portion that is bent downward from the outer edge portion and that is formed following the straight-line outer edge portion, and a curved vertical wall portion that is formed following the curved-line outer edge portion; and a flange section including a straight-line flange portion that extends from the flat vertical wall portion toward the outside, and that is formed following the straight-line outer edge portion, and a curved-line flange portion that is formed following the curved-line outer edge portion and that extends from the curved vertical wall portion toward the outside, wherein the width of an end portion of the top plate section on the curved-line portion side is 150 mm or greater, and the pressed product is obtained by pressing, with cold bending, material of a blank having a tensile strength of from 400 MPa to 1600 MPa, or of a forming plate of the blank on which pre-processing has been performed.

Advantageous Effects of Invention

Pressing forming the blank or the forming plate of the present invention enables the occurrence of creasing and cracking in the press formed article to be prevented or suppressed. The press formed article manufacturing method of the present invention enables a press formed article to be manufactured in which the occurrence of creasing and cracking has been suppressed or prevented. The press formed article of the present invention is one that has been manufactured in a desired shape from a high strength blank, with the occurrence of creasing and cracking suppressed or prevented.

DESCRIPTION OF EMBODIMENTS

Explanation follows regarding a blank, a press formed article, and a manufacturing method thereof according to an exemplary embodiment of the present invention, with reference to FIG. 1 to FIG. 11 and FIG. 20. Note that in the present exemplary embodiment, "plan view" means viewed along the direction of relative movement between a die and a bending mold during pressing.

In the present exemplary embodiment, an example is given in which the press formed article is an L-shaped profile component. However, the present invention is not limited to an L-shaped profile component, and may be similarly applied to press formed articles such as a T-shaped profile component and a Y-shaped profile component that include both a lateral cross-section profile described later and a curved portion.

It is sufficient that the blank is a metal plate suitable for pressing, and the material properties thereof are not particularly limited. The blank is preferably plate metal suitable for pressing, such as a steel plate, an aluminum plate, or an alloy plate with main components of steel or aluminum. In the present exemplary embodiment, an example is given in which the blank is a steel plate.

1. Press Formed Article

Figure 1:
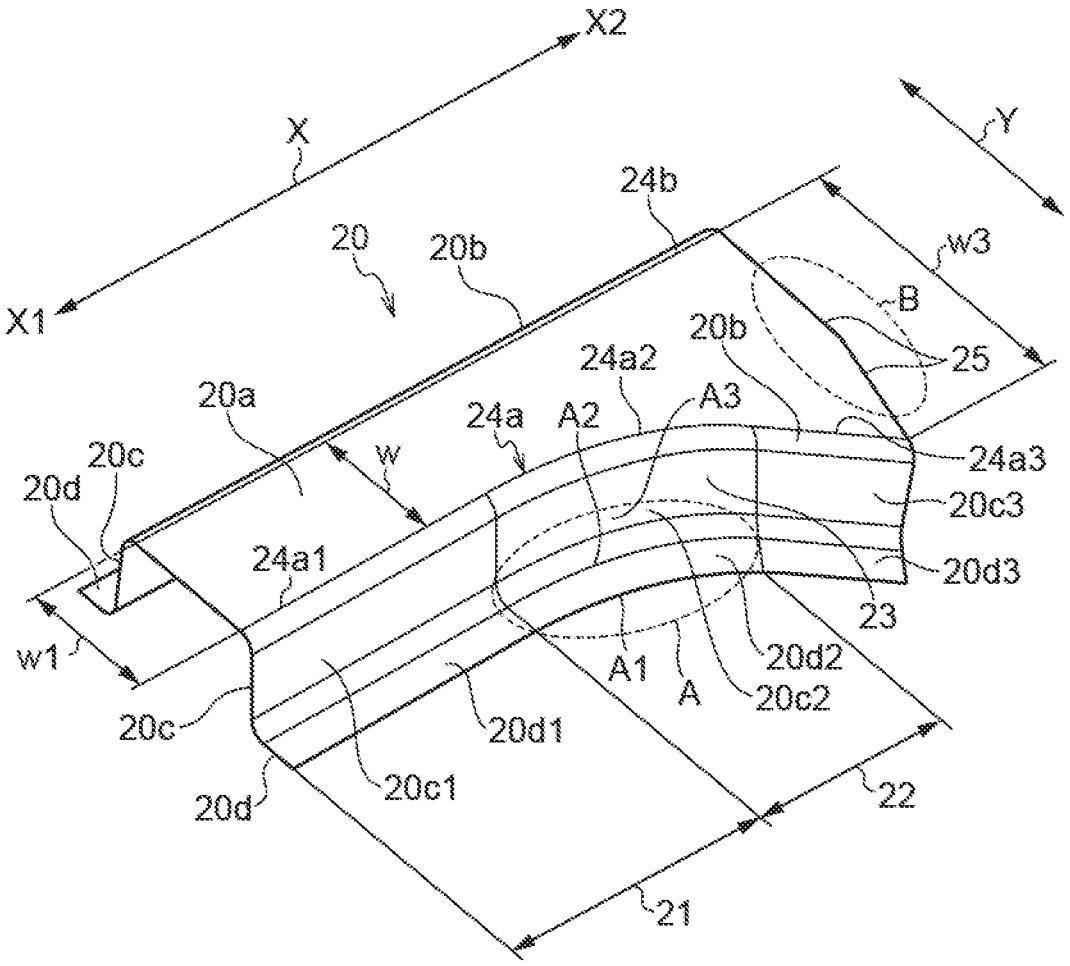
FIG. 1 is a schematic explanatory diagram illustrating a simplified shape of an L-shaped profile component that is a press formed article according to an exemplary embodiment of the present invention.
Figure 2:
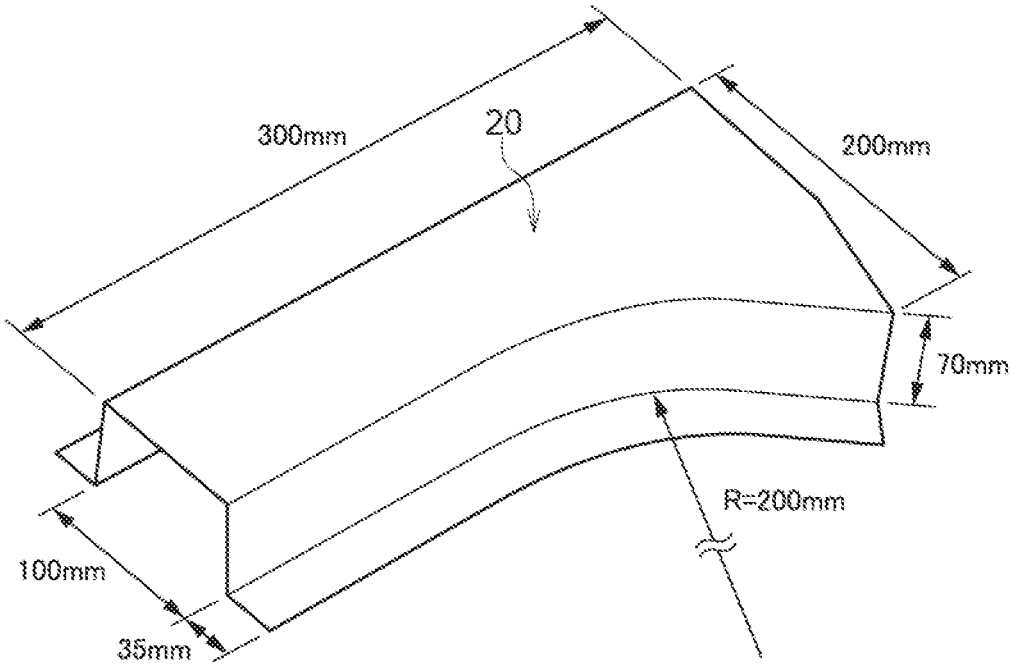
FIG. 2 is a schematic explanatory diagram illustrating an example of dimensions of relevant portions of an L-shaped profile component according to an exemplary embodiment of the present invention.
Figure 3:
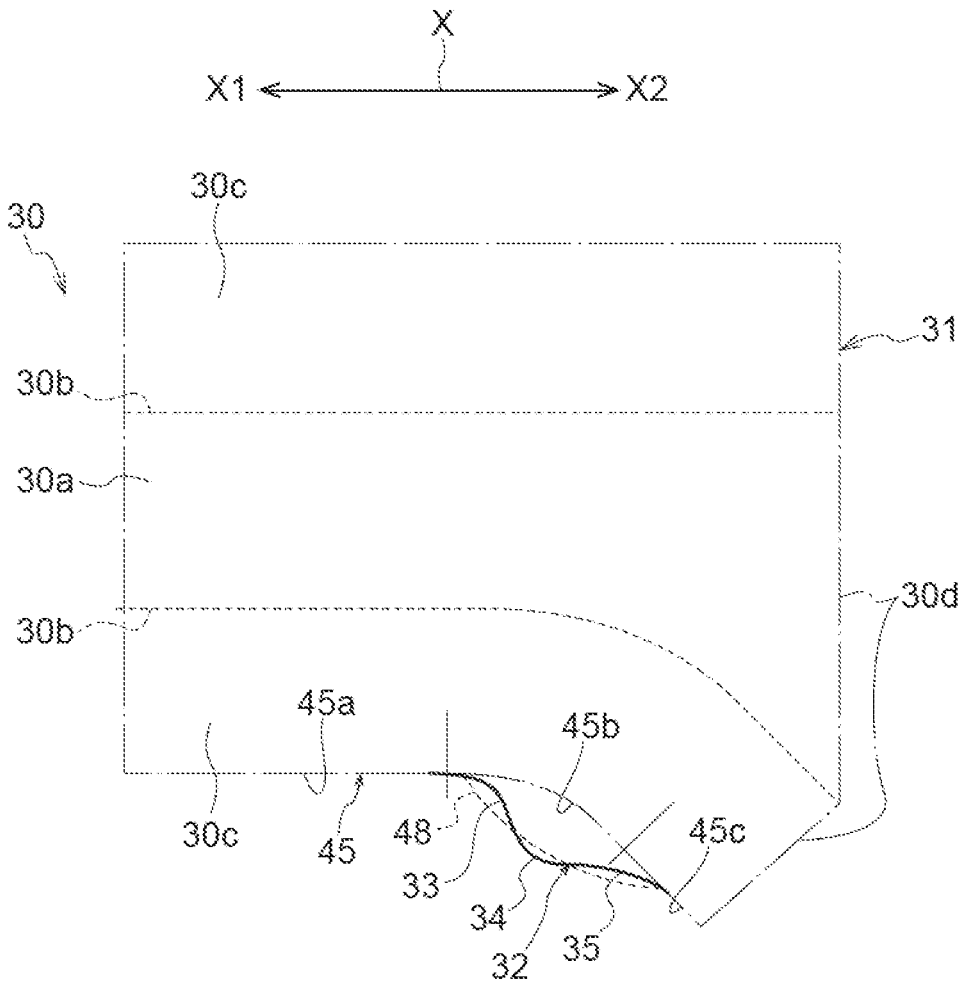
FIG. 3 is a schematic explanatory diagram illustrating a schematic shape of a blank for an L-shaped profile component according to an exemplary embodiment of the present invention.

FIG. 1 is a simplified explanatory diagram of the shape of an L-shaped profile component 20, this being an elongated press formed article according to the present exemplary embodiment. FIG. 2 is an explanatory diagram illustrating an example of dimensions of relevant portions of the press formed article. FIG. 3 is a schematic explanatory diagram illustrating the shape of a blank 30 of the L-shaped profile component 20 according to the present exemplary embodiment.

As illustrated in FIG. 1, the L-shaped profile component 20 is an elongated press formed article that is elongated along a length direction (the arrow X direction in FIG. 1 (also referred to below as the X direction)). The dimension of the L-shaped profile component 20 in the X direction is in a range of from 100 mm to 1400 mm, and is, for example, 300 mm, as illustrated in FIG. 2.

The L-shaped profile component 20 has a substantially hat shaped lateral cross-section profile, and includes a top plate section 20*a* with a substantially L-shape in plan view, two vertical wall sections 20*c*, 20*c* extending downward from both ends in a direction orthogonal to the X direction of the top plate section 20*a* (the arrow Y direction orthogonal to the X direction in the present exemplary embodiment (also referred to below as the Y direction)) of the top plate section 20*a*, and two flange sections 20*d*, 20*d* extending toward the outside from lower end portions of the two vertical wall sections 20*c*, 20*c*. Ridge line sections 20*b*, 20*b* having rounded profile lateral cross-sections are provided between the top plate section 20*a* and the vertical wall sections 20*c*, 20*c*.

The top plate section 20*a* includes outer edge portions 24*a*, 24*b* that form boundary lines with the ridge line sections 20*b*, 20*b* at both Y direction end portions of the top plate section 20*a*. The outer edge portion 24*a* includes a straight-line outer edge portion 24*a*1 extending along a straight line in plan view from one X direction (also referred to below as the "X1 direction") end portion, a curved-line outer edge portion 24*a*2 that is contiguous to the straight-line outer edge portion 24*a*1 and curves so as to form a convex shape protruding toward the inside in plan view, and that diverges from the outer edge portion 24*b* on progression toward the other X direction (also referred to below as the "X2 direction"), and a straight-line outer edge portion 24*a*3 that is contiguous to the curved-line outer edge portion 24*a*2 and extends along a straight line in plan view. Note that the outer edge portion 24*b* on the opposite side is formed by a straight-line outer edge portion having a purely straight line shape in plan view.

The top plate section 20*a* extends along the X direction and has a specific width w in the Y direction. A width w1 at an X1 direction end portion of the top plate section 20*a* is in a range of from 50 mm to 200 mm, and is, for example, 100 mm, as illustrated in FIG. 2. A width w3 at an X2 direction end portion of the top plate section 20*a* is in a range of from 70 mm to 1000 mm, and is, for example, 200 mm as illustrated in FIG. 2.

In the L-shaped profile component 20, a "base section of the L" means the X2 direction end portion 25 of the top plate section 20*a*, as illustrated in FIG. 1. In cases such as in the present exemplary embodiment, in which the end portion is formed from plural portions in plan view (two straight lines in the present exemplary embodiment), all of these portions are included.

Next, explanation follows regarding the vertical wall sections 20*c*, 20*c*.

The vertical wall section 20*c* on the outer edge portion 24*a* side includes a straight vertical wall portion 20*c*1 following the straight-line outer edge portion 24*a*1 and forming a straight line shape from the X1 direction end portion in plan view, a curved vertical wall portion 20*c*2 following the curved-line outer edge portion 24*a*2 and forming a curved shape that is convex so as to protrude toward the inside in plan view, and a straight vertical wall portion 20*c*3 following the straight-line outer edge portion 24*a*3 and forming a straight line shape in plan view. Note that the vertical wall section 20*c* on the opposite side is formed from a vertical wall section with a purely straight line shape in plan view.

The height of the vertical wall sections 20*c*, 20*c* is in a range of from 20 mm to 120 mm, and is, for example, 70 mm as illustrated in FIG. 2. If the height of the vertical wall section 20*c* is below 0.2 times the length of the curved-line outer edge portion 24*a*2, or below 20 mm, creasing of the vertical wall section 20*c* is liable to occur. The height of the vertical wall section 20*c* is accordingly preferably 0.2 times the length of the curved-line outer edge portion 24*a*2 or greater, and also 20 mm or greater.

The maximum radius of curvature of the vertical wall section 20*c* (curved vertical wall portion 20*c*2) in plan view, namely the maximum radius of curvature ($R_{MAX}$) of the outer edge portion 24*a* (curved-line outer edge portion 24*a*2), is preferably from 5 mm to 300 mm. If the maximum radius of curvature is less than 5 mm, a maximum curvature portion juts out locally and is therefore vulnerable to cracking. If the maximum radius of curvature is greater than 300 mm, then a large difference arises between the width w3 of the X2 direction end portion of the top plate section 20*a* and the width w1 of the X1 direction end portion, and the pulling distance into the vertical wall section 20*c* during pressing increases, giving a large distance of sliding between a mold unit 40, which will be described later, and the blank 30, exacerbating abrasion of the mold unit 40 and reducing the mold lifespan. The maximum radius of curvature of the curved vertical wall portion 20*c*2 (curved-line outer edge portion 24*a*2) is thus preferably 100 mm or below.

Next, explanation follows regarding the flange sections 20*d*, 20*d*.

The flange section 20*d* on the outer edge portion 24*a* side includes a straight-line flange portion 20*d*1 following the outer edge portion 24*a* and with an edge from the X1 direction end portion forming a straight line shape in plan view, a curved-line flange portion 20*d*2 in a curved shape having an edge indented toward the inside, and a straight-line flange portion 20*d*3 forming a straight line shape. Note that the flange section 20*d* on the opposite side is formed from a straight-line flange portion with a purely straight line shape in plan view.

The two flange sections 20*d*, 20*d* both have a width in a range of from 10 mm to 100 mm, for example 35 mm, as illustrated in FIG. 2.

Figure 4A:
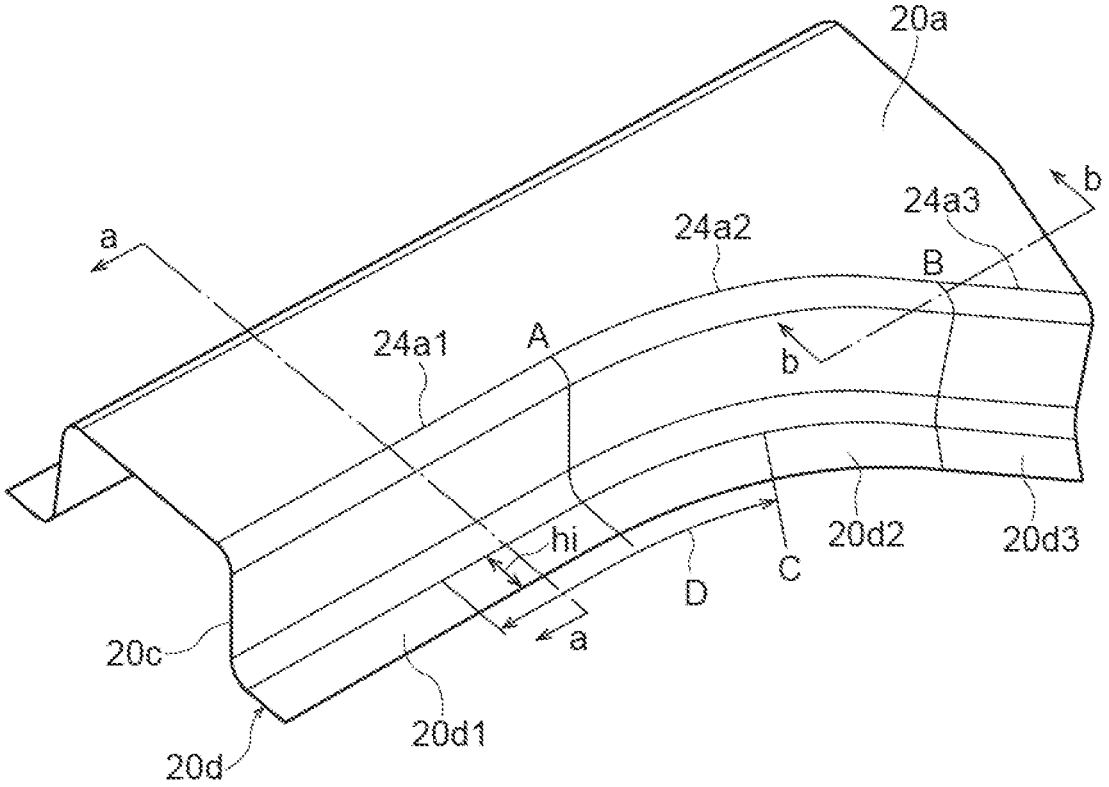
FIG. 4A is a perspective view illustrating the vicinity of a curved vertical wall portion of an L-shaped profile component according to an exemplary embodiment of the present invention.

In the manufacturing method according to the present exemplary embodiment, as illustrated in FIG. 4A, the width $h_i$ of the flange section 20*d* at a side further toward a first end portion A than the center C of the curved vertical wall portion 20*c*2 (meaning at the end point of the curved vertical wall portion 20*c*2 on the X1 direction side) may be from 25 mm to 100 mm. More specifically, pressing is preferably performed such that the width $h_i$ of the flange section 20*d* is from 25 mm to 100 mm in the section D in FIG. 4A, which will be described later, spanning from the center line C of the flange section 20*d*, past the flange section 20*d* at the end portion A, and up to a position 50 mm away from the flange section 20*d* along the flange peripheral direction on the end portion A side.

The width $h_i$ of the flange section 20*d* is defined as the distance of the flange section 20*d* in a direction orthogonal to a tangent at a freely selected position of an edge of the flange section 20*d*.

If there are locations where the flange width $h_i$ of the flange section 20*d* in the section D is below 25 mm, a reduction in plate thickness at the flange section 20*d* becomes large, and cracking is liable to occur. This is due to force pulling the X2 direction end portion of the top plate section 20*a* (the vicinity of portion B in FIG. 1) into the vertical wall section 20*c* becoming concentrated in the vicinity of the flange section during the forming process.

If there are locations where the flange width $h_i$ of the flange section 20*d* in the section D exceeds 100 mm, then the flange section 20*d* is compressed by a large amount, and creasing is liable to occur.

Accordingly, the occurrence of creasing and cracking in the flange section 20*d* can be suppressed by setting the flange width $h_i$ of the flange section 20*d* in the section D from 25 mm to 100 mm.

Accordingly, when manufacturing a component with a shape in which the flange width $h_i$ of the flange section 20*d* is less than 25 mm, an intermediate pressed body having a flange section 20*d* of width 25 mm or greater is preferably manufactured by pressing, with the unwanted portion then being trimmed off.

For convenience, the L-shaped profile component 20 is divided into a first portion 21 and a second portion 22 at an X direction boundary position between the straight-line outer edge portion 24*a*1 and the curved-line outer edge portion 24*a*2. In the first portion 21, the vertical wall sections 20*c*, 20*c* are formed with parallel straight line shapes in plan view, such that the width w1 of the top plate section 20*a* is substantially uniform.

On the other hand, in the second portion 22, out of the vertical wall sections 20*c*, 20*c*, the curved vertical wall portion 20*c*2 (curved-line outer edge portion 24*a*2) curves substantially toward the plate thickness direction, such that the width w of the top plate section 20*a* gradually increases on progression toward the X2 direction end portion, thereby giving the top plate section 20*a* a substantially L-shape in plan view. The radius of curvature of the curved vertical wall portion 20*c*2 is in a range of from 5 mm to 500 mm, and is, for example, 200 mm as illustrated in FIG. 2.

Note that the curved-line outer edge portion 24*a*2, the curved vertical wall portion 20*c*2, and the curved-line flange section 20*d*2 are also collectively referred to as a curved portion 23.

In plan view, the curved-line outer edge portion 24*a*2 of the L-shaped profile component 20 may have a profile with a uniform curvature, an elliptical profile, a profile including plural curvatures, or a profile including a straight-line portion. Namely, in the L-shaped profile component 20, in plan view the top plate section 20*a* is present to the outside of the curved arc shape of the ridge line section 20*b* (curved-line outer edge portion 24*a*2), and the flange section 20*d* is present at the inside (the arc center side) of the curved arc shape of the ridge line section 20*b*. Note that the top plate section 20*a* does not need to be a perfectly flat face, and various additional shapes (such as recesses or protrusions) may be imparted to the top plate section 20*a* according to the design of the press formed article.

As illustrated in FIG. 4A, out of the two end portions of the curved-line outer edge portion 24*a*2 of the L-shaped profile component 20, the X1 direction end portion is referred to as the end portion A (first end portion), and the X2 direction end portion is referred to as the end portion B (second end portion).

An example is illustrated in which the width w3 of the X2 direction end portion of the top plate section 20*a* is 150 mm or greater. Hitherto, when manufacturing center pillar reinforcement, this being a typical example of a T-shaped profile component, by pressing using the free bending method, it has been necessary to modify the shape of the blank in order to prevent the occurrence of flange cracking and top plate edge cracking, and it has been difficult to set the width w3 at a base section of the center pillar reinforcement greater than 150 mm. However, the L-shaped profile component 20 according to the present exemplary embodiment is formed using the free bending method employing the blank 30, described later, rendering modification of the shape of the blank in order to prevent the occurrence of flange cracking and top plate edge cracking unnecessary, and enabling a width w3 of 150 mm or greater to be secured for the X2 direction end portion of the top plate section 20*a*.

A portion of the second portion 22 including the X2 direction end portion configures a joint portion with other members (for example a roof rail or a side sill), and joining to the other members through this portion is performed by appropriate means (such as spot welding or laser welding).

The press formed article 20 according to the present exemplary embodiment accordingly enables an increase in the joint surface area of the portion configuring the joint portion with other members, and enables the joint strength with the other members to be raised. Increased bending rigidity and increased twisting rigidity of the automotive body shell is enabled when the press formed article is an automotive vehicle body configuration member (such as various pillar outer reinforcements or sill outer reinforcements).

The above explanation similarly applies to cases in which one of the vertical wall sections 20*c* out of the two vertical wall sections 20*c*, 20*c*, and the ridge line section 20*b* and flange section 20*d* that are connected to this vertical wall section 20*c*, all curve substantially toward the plate thickness direction of the vertical wall section 20*c*, namely, to use the example of the L-shaped profile component 20, in cases in which both of the vertical wall sections 20*c* out of the two vertical wall sections 20*c*, 20*c*, and the ridge line sections 20*b* and flange sections 20*d* respectively connected to these vertical wall sections 20*c*, all curve substantially toward the plate thickness direction of the vertical wall section 20*c*. Namely, the above explanation similarly applies to T-shaped profile components and Y-shaped profile components.

The L-shaped profile component 20 that is a press formed article according to the present exemplary embodiment is configured as described above.

2. Blank

Next, explanation follows regarding the blank 30, this being a plate metal material for pressing the L-shaped profile component 20.

As illustrated in FIG. 3, the blank 30 is manufactured by cutting a specific shape out of a steel plate material using an appropriate method (such as laser cutting).

Pre-processing performed on the blank 30 includes, for example, bending to form light protrusions in the interior of the blank 30, pressing by drawing, and hole cutting. Such pre-processing may be performed on the blank 30 as appropriate in consideration of the dimensions and shape of the press formed article 20.

The blank 30 is configured with a shape 31 of the press formed article 20 as it is opened-out (the shape illustrated by single-dotted intermittent lines in FIG. 3, also sometimes referred to as the "opened-out shape" in the present specification), namely a shape combining a portion 30*a* that will form the top plate section 20*a*, portions 30*b*, 30*b* that will form the outer edge portions 24*a*, 24*b*, and portions 30*c*, 30*c* that will form the ridge line sections 20*b*, 20*b*, the vertical wall sections 20*c*, 20*c*, and the flange sections 20*d*, 20*d*, to which a bulging portion 48 is additionally provided at an edge of a portion that will form the flange section 20*d* including the curved-line flange portion 20*d*2. An edge of the bulging portion 48 is configured by an excess portion 32 provided with a first recess 33, a protrusion 34, and a second recess 35 that satisfy Condition 1, described below.

As illustrated in FIG. 3, an edge portion 45 of the portion of the opened-out shape 31 that will form the flange section 20*d* is formed, from the X1 direction end portion, with a straight-line edge portion 45*a*, a curved-line edge portion 45*b*, and a straight-line edge portion 45*c*, similarly to the flange section 20*d* of the L-shaped profile component 20.

Condition 1: Taking a curvature in a direction toward the inside of the blank 30 as having a negative sign, and taking a curvature in the opposite direction to toward the inside of the blank 30 as having a positive sign, the first recess 33 with a negative sign curvature, the protrusion 34 with a positive sign curvature, and the second recess 35 with a negative sign curvature are formed in this sequence along the edge of the excess portion 32.

The blank 30 preferably also satisfies Conditions 2 and 3 below.

Condition 2: In plan view, the edge length of the protrusion 30 (edge lengths in plan view are sometimes also referred to below as "edge lengths") is the edge length of the curved-line edge portion 45*b* or shorter. The protrusion 34 is provided in order to prevent flange cracking, and, since it is the curved-line flange portion 20*d*2 where flange cracking is liable to occur, the edge length of the protrusion 34 is preferably the edge length of the curved-line edge portion 45*b* or shorter.

Note that in the blank 30, "plan view" means as viewed along a direction orthogonal to the extension direction of the plate.

The edge lengths of the first recess 33, the protrusion 34, and the second recess 35 refer to the distance between inflection points on the edge of the blank 30.

Condition 3: The absolute values of the respective curvatures of the first recess 33 and the second recess 35 are both 0.1 (l/mm) or below. The first recess 33 and the second recess 35 are provided in order to prevent top plate edge cracking, and the first recess 33 and the second recess 35 straighten out and suppress inflow of the blank 30 into the mold during pressing. Accordingly, if the absolute values of the respective curvatures of the first recess 33 and the second recess 35 are large, stress concentration occurs at the first recess 33 and the second recess 35 respectively, and edge cracking is liable to occur at the first recess 33 and the second recess 35 respectively. Accordingly, the absolute values of the respective curvatures of the first recess 33 and the second recess 35 are preferably set to 0.1 (l/mm) or below.

The opened-out shape 31 is the shape on which the shape of the blank 30 is based, and is the shape of the top plate section 20*a*, the ridge line sections 20*b*, 20*b*, the vertical wall sections 20*c*, 20*c*, and the flange sections 20*d*, 20*d* as opened out flat. The opened-out shape 31 is the shape obtained by adding, to the portion that will form the top plate section 20*a*, portions that will form the ridge line sections 20*b*, 20*b*, portions that will form the vertical wall sections 20*c*, 20*c*, and portions that will form the flange sections 20*d*, 20*d*.

As described above, the excess portion 32 is a portion that is the basis for preventing flange cracking and top plate edge cracking, and the range and size for forming the excess portion 32 may be decided from these perspectives. For example, an excess portion 32 having a width (the distance from a boundary line between the vertical wall section 20*c* and the flange section 20*d*, to the edge of the excess portion 32) of from ½ to 3/2 times the height of the vertical wall section 20*c* of the L-shaped profile component 20 product is preferably formed at the portion that will form the curved-line flange portion 20*d*2 of the L-shaped profile component 20. This is to prevent fluctuations in the excess portion 32 according to the shape (length) of the flange section 20*d* of the L-shaped profile component 20. Flange cracking occurs if the width of the excess portion 32 is less than ½ the height of the vertical wall section 20*c*, and flange creasing and vertical wall cracking occur if the width of the excess portion 32 exceeds 3/2 of the height of the vertical wall section 20*c*.

In the manufacturing method according to the present exemplary embodiment, a reduction in the plate thickness of the flange section 20*d* during forming is suppressed, thereby enabling good pressing to be achieved not only when employing the blank 30 configured from a steel plate with high ductility and comparatively low strength (for example, a steel plate with tensile strength of approximately 400 MPa), but also when employing blanks configured from a steel plate with low ductility and comparatively high strength (for example, a steel plate with tensile strength of approximately 1600 MPa). This thereby enables high strength plate steel with a tensile strength from 400 MPa to 1600 MPa to be employed for the blank 30.

Figure 7:
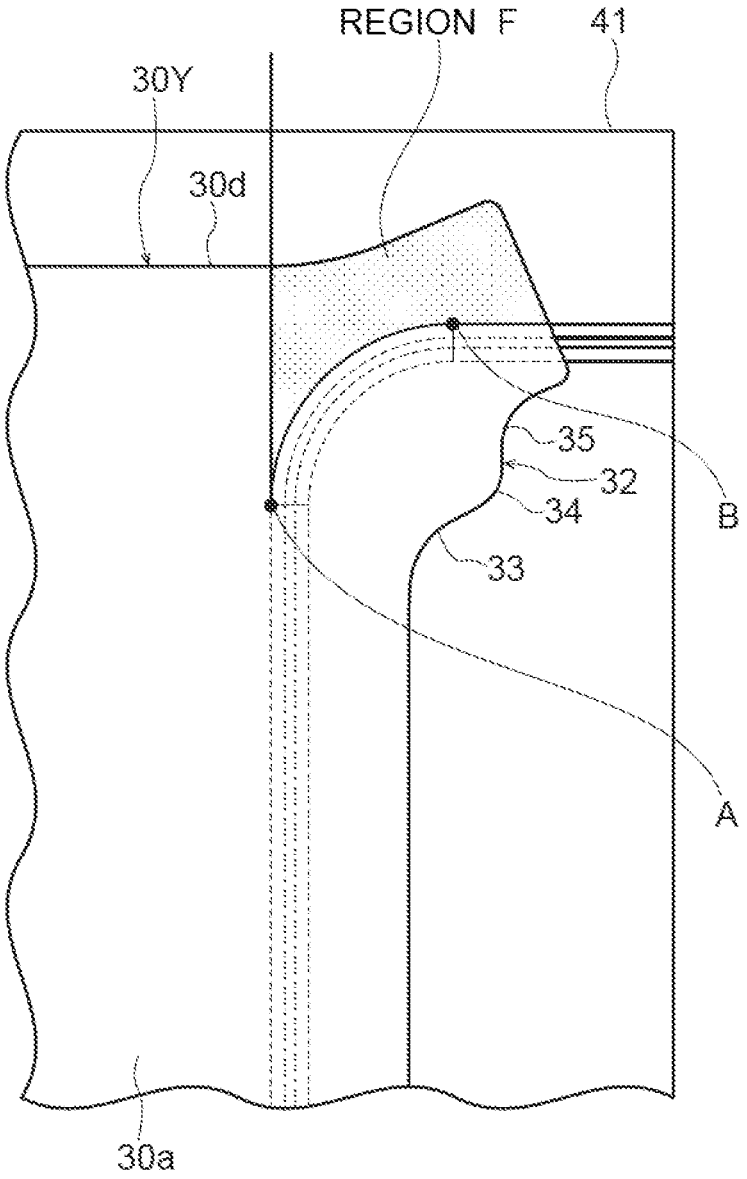
FIG. 7 is a schematic explanatory diagram illustrating an out-of-plane deformation suppression region (region F) of a blank by hatching.

An X2 direction end portion 30*d* of the blank 30 preferably has a shape in which at least a portion of the end portion is disposed in the same plane as the portion 30*a* that will form the top plate section 20*a*, namely preferably has a shape in which the end portion remains unaffected during pressing. Moreover, as illustrated in FIG. 7 described later, out of the blank 30, the end portion at a location corresponding to an out-of-plane deformation suppression region (region F) is preferably in the same plane as the portion 30*a*. In other words, a portion of the blank 30 that is an end portion of the blank 30 and that is present further to the side that will form the top plate section 20*a* than a portion that will form the curved-line outer edge portion 24*a*2 and the straight-line outer edge portion 24*a*3 in a location corresponding to the out-of-plane deformation suppression region, is preferably present in the same plane as the portion that will form the top plate section 20*a*.

Figure 20A:
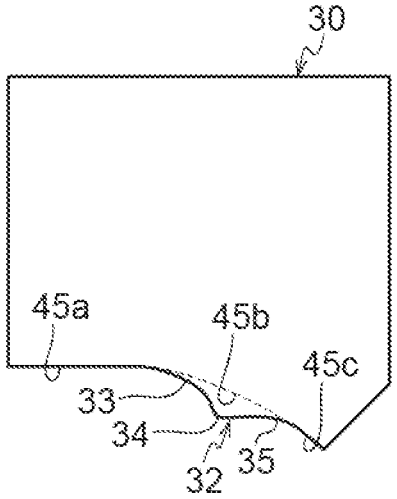
FIG. 20A is a schematic explanatory diagram illustrating a variation in shape of a blank according to an exemplary embodiment of the present invention.
Figure 20B:
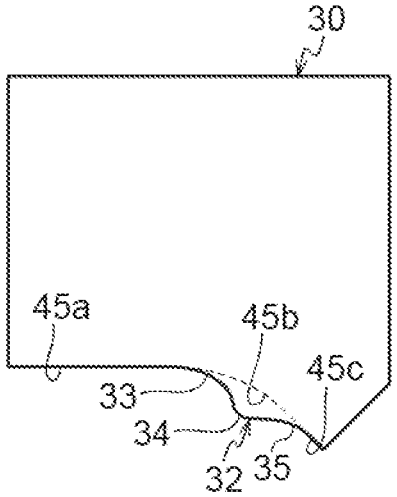
FIG. 20B is a schematic explanatory diagram illustrating a variation in shape of a blank according to an exemplary embodiment of the present invention.
Figure 20C:
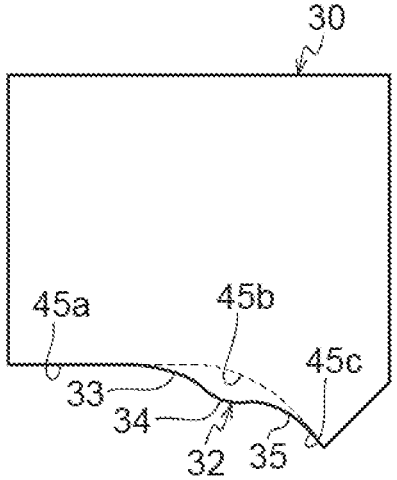
FIG. 20C is a schematic explanatory diagram illustrating a variation in shape of a blank according to an exemplary embodiment of the present invention.
Figure 20D:
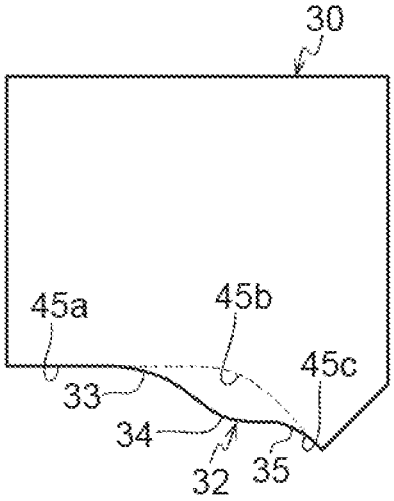
FIG. 20D is a schematic explanatory diagram illustrating a variation in shape of a blank according to an exemplary embodiment of the present invention.
Figure 20E:
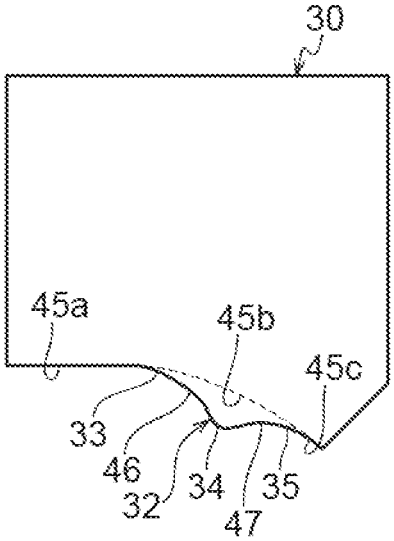
FIG. 20E is a schematic explanatory diagram illustrating a variation in shape of a blank according to an exemplary embodiment of the present invention.

In contrast to the blank 30 illustrated in FIG. 3, a straight-line portion may be present at one or both locations out of between the first recess 33 and the protrusion 34, and between the second recess 35 and the protrusion 34 (see the straight-line portions 46, 47 in FIG. 20E). Accordingly, in cases in which small respective radii suffice for the curvature of the first recess 33, the protrusion 34, and the second recess 35, the excess portion 32 may be formed so as to include desired edges of the first recess 33, the protrusion 34, and the second recess 35, without the need to employ large radii of curvature, with this being preferable.

Note that there are various conceivable layouts for the excess portion 32 provided to the blank 30, as illustrated in FIG. 20A to FIG. 20E.

As illustrated in FIG. 20A to FIG. 20E, conceivable blanks 30 include a blank 30 in which the first recess 33, the protrusion 34, and the second recess 35 of the excess portion 32 are all provided within the range of the curved-line edge portion 45*b* (see FIG. 20A), a blank 30 in which the start point of the first recess 33 is at a straight-line edge portion 45*a* (see FIG. 20B), and a blank 30 in which the start point of the second recess 35 is at a straight-line edge portion 45*c* (see FIG. 20C).

Moreover, a blank 30 is conceivable in which the first recess 33 is formed to the straight-line edge portion 45*a*, the protrusion 34 is formed to the curved-line edge portion 45*b*, and the second recess 35 is formed to the straight-line edge portion 45*c* (see FIG. 20D).

Moreover, a blank 30 is conceivable in which the straight-line portions 46, 47 that are straight line shaped in plan view are formed between the first recess 33 and protrusion 34, and between the protrusion 34 and the second recess 35 (see FIG. 20E). These are merely examples, and there is no limitation thereto.

3. Manufacturing Method of Press Formed Article According to Present Exemplary Embodiment Regarding the manufacturing method of the press formed article according to the present exemplary embodiment, first, explanation follows regarding the free bending method, followed by explanation regarding operation and advantageous effects when this is applied to the blank 30 according to the present exemplary embodiment.

Briefly stated, the press formed article manufacturing method is one in which the press formed article 20 according to the present invention, as described above, is manufactured by pressing the blank 30 according to the present invention as described above using cold bending that employs the free bending method described in Patent Document 5. Since the free bending method is already known through Patent Document 5, simplified explanation is given below.

The free bending method explained here employs an L-shaped profile component 20Y and a blank 30Y that are shaped differently to the L-shaped profile component 20 and the blank 30 employed in the above explanation; however, there is no change to the operation and the like. Moreover, configuration elements of the L-shaped profile component 20Y and the blank 30Y that are configuration elements similar to those of the L-shaped profile component 20 and the blank 30 are allocated the same reference numerals, and detailed explanation thereof is omitted.

Figure 4B:
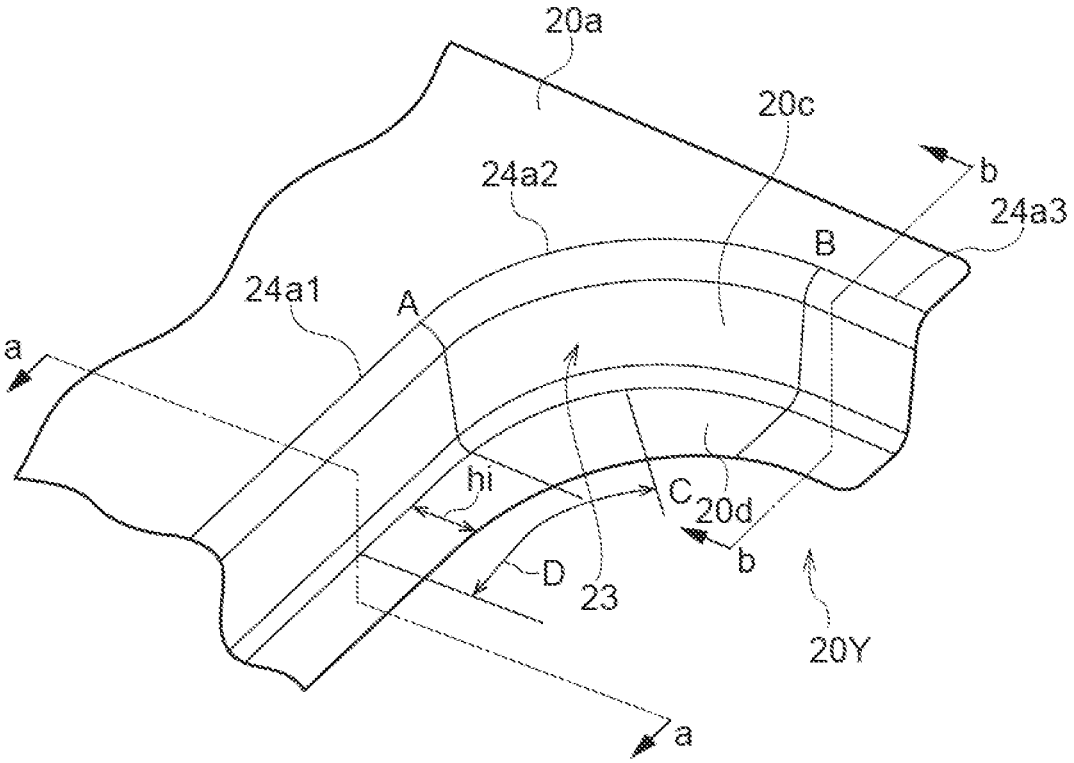
FIG. 4B is a perspective view illustrating the vicinity of a curved vertical wall portion of an L-shaped profile component obtained by a manufacturing method according to an exemplary embodiment of the present invention.
Figure 5:
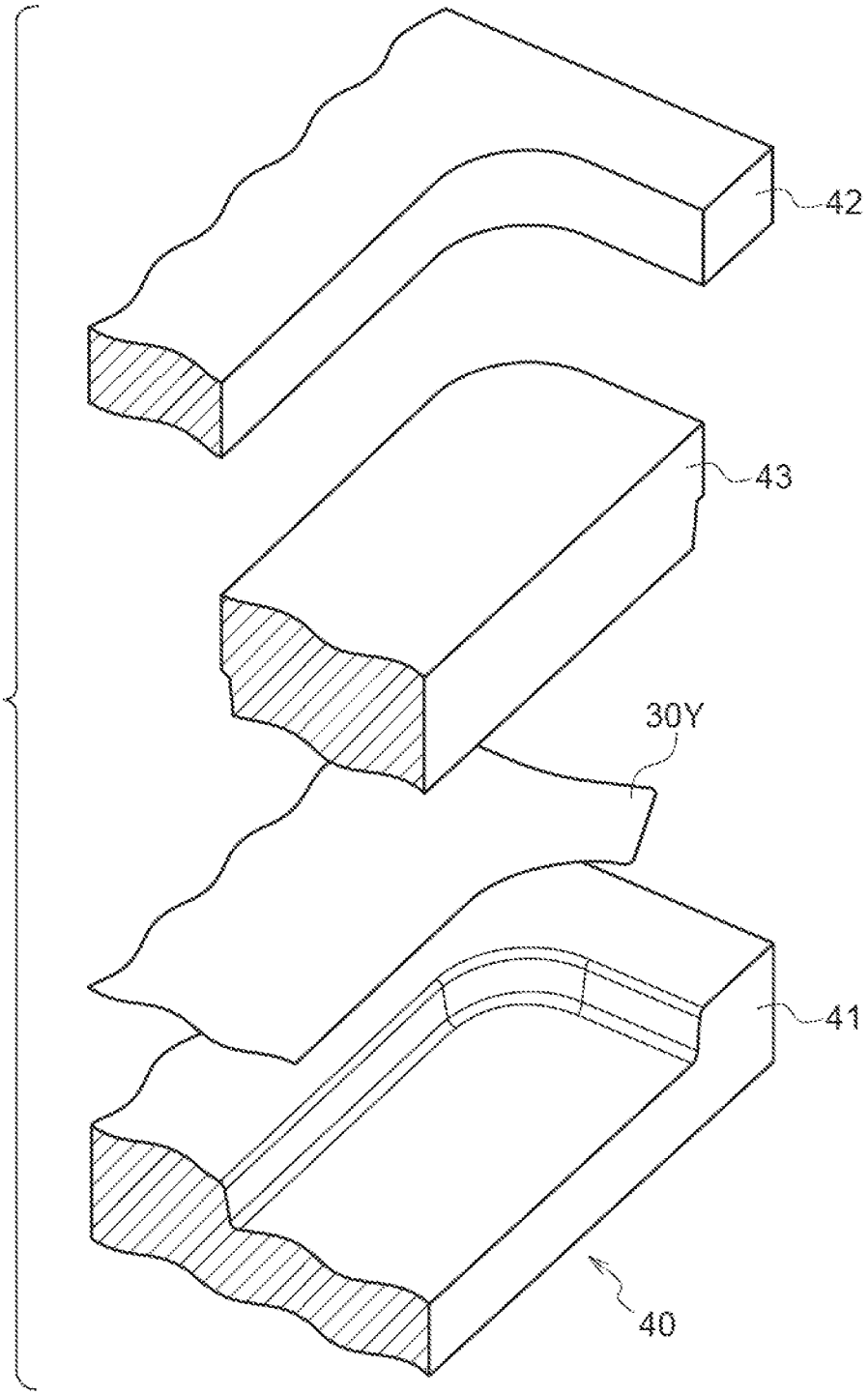
FIG. 5 is a schematic explanatory diagram illustrating an outline of a mold unit employed during execution of a manufacturing method according to an exemplary embodiment of the present invention.
Figure 6A:
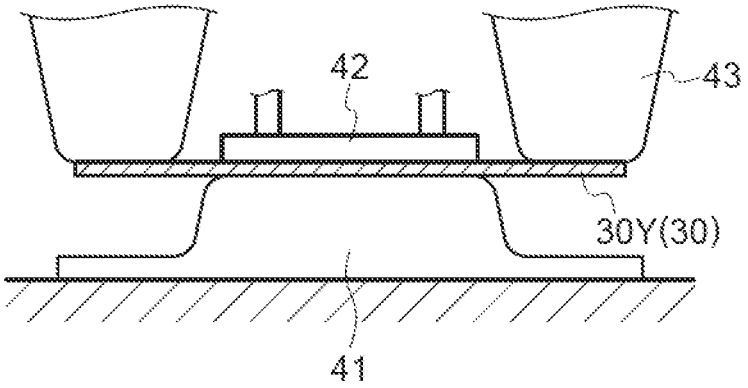
FIG. 6A is a cross-section taken along line a-a in FIG. 4B, schematically illustrating the mold unit illustrated in FIG. 5 prior to the start of pressing.
Figure 6B:
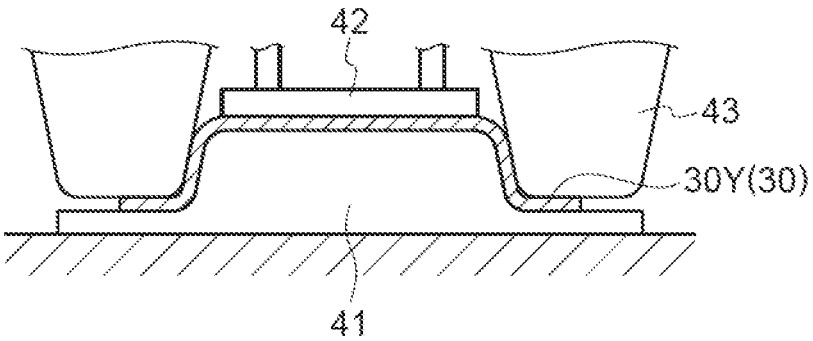
FIG. 6B is an explanatory diagram of a cross-section taken along line a-a in FIG. 4B, schematically illustrating the mold unit illustrated in FIG. 5 upon completion of pressing.
Figure 6C:
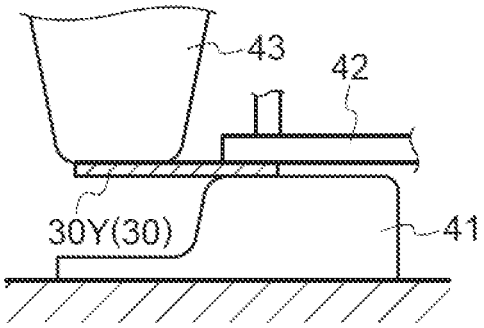
FIG. 6C is a cross-section taken along line b-b in FIG. 4B, schematically illustrating the mold unit illustrated in FIG. 5 prior to the start of pressing.
Figure 6D:
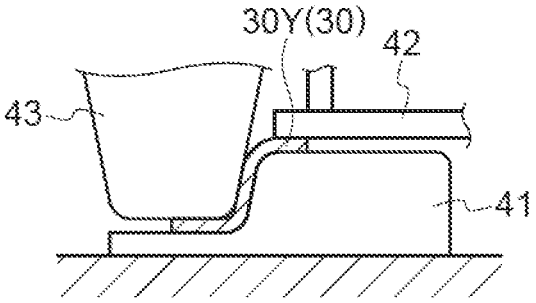
FIG. 6D is a cross-section explanatory diagram taken along line b-b in FIG. 4B, schematically illustrating the mold unit illustrated in FIG. 5 upon completion of pressing.

FIG. 4B is a perspective view of the curved portion 23 of the L-shaped profile component 20 obtained by the present manufacturing method. FIG. 5 is a schematic explanatory drawing of the mold unit 40 employed to carry out the present manufacturing method. FIG. 6A and FIG. 6B are cross-sections taken along line a-a in FIG. 4B, and schematically illustrate respective states prior to starting pressing, and on completion of pressing, using the mold unit 40 illustrated in FIG. 5. FIG. 6C and FIG. 6D are cross-sections taken along line b-b in FIG. 4B, and schematically illustrate respective states prior to starting pressing, and on completion of pressing, using the mold unit 40 illustrated in FIG. 5.

Firstly, explanation follows regarding the mold unit 40, with reference to FIG. 5. The mold unit 40 includes a die 41 on which the blank 30Y is placed, a pad 42 that is disposed on the other side of the blank 30 to that of the die 41, and a bending mold 43 that presses the blank 30 by moving relative to the die 41.

A drive mechanism of the pad 42 may employ springs or hydraulics in cases in which the blank 30 is applied with pressure to an extent that permits in-plane movement of locations corresponding to the out-of-plane deformation suppression region (region F), described later, and the like. The pad 42 may also be configured by a gas cushion.

The drive mechanism of the pad 42 may be an electric cylinder or a hydraulic servo when employed in cases in which the vertical wall section 20*c* and the flange section 20*d* are formed in a state in which a gap between the pad 42 and the die 41 at a portion in the vicinity of, or contacting, the out-of-plane deformation suppression region (region F) is maintained at a gap from the plate thickness of the blank 30 to 1.1 times the plate thickness of the blank 30. Note that the up-down positional relationship of the die 41 and the bending mold 43 may be inverted.

In this method, the vertical wall section 20*c* and the flange section 20*d* are formed in a state in which it is possible for a region of at least a portion of the blank 30Y (at least a portion of a region of the blank 30 corresponding to the top plate section 20*a*) to slide (move in-plane) over a location of the die 41 corresponding to the top plate section 20*a*. Namely, the vertical wall section 20*c* and the flange section 20*d* are formed by placing the blank 30Y between the die 41, and the pad 42 and bending mold 43, and at least a portion of the blank 30Y is slid over the location of the die 41 corresponding to the top plate section 20*a* in a state in which the pad 42 is in the vicinity of, or in contact with, the blank 30Y.

Note that "a state in which the pad 42 is in the vicinity of the blank 30Y" means a state in which the blank 30Y and the pad 42 do not contact each other when the blank 30Y slides over the location of the die 41 corresponding to the top plate section 20*a*, but the blank 30Y and the pad 42 do contact each other if the blank 30Y attempts to deform (or buckle) out-of-plane above this location. More strictly speaking, "a state in which the pad 42 is in the vicinity of the blank 30Y" means a state in which the gap between the pad 42 and the die 41 is maintained at greater than 1.0 times the plate thickness of the blank 30Y, up to and including 1.1 times the plate thickness of the blank 30Y.

When forming the vertical wall section 20*c* and the flange section 20*d*, forming may be performed in a state in which the gap between the pad 42 and the die 41 at a portion where the pad 42 is in the vicinity of, or in contact with, the out-of-plane deformation suppression region (region F) that is a portion of the blank 30Y, is maintained at greater than 1.0 times the plate thickness of the blank 30Y, and up to and including 1.1 times the plate thickness of the blank 30Y.

For example, in cases in which forming is performed in a state in which the gap between the pad 42 and the die 41 at the portion corresponding to the top plate section 20*a* is maintained at from the plate thickness of the blank 30Y to 1.1 times the plate thickness of the blank 30Y, excessive surface pressure does not act on the blank 30Y, thereby enabling the blank 30Y to slide (move in-plane) sufficiently within the mold unit 40 during pressing. Moreover, as forming progresses, if excess has arisen in the top plate section 20*a* and a force acts to cause out-of-plane deformation of the blank 30Y, out-of-plane deformation of the blank 30Y is restricted by the pad 42, thereby enabling the occurrence of cracking and creasing to be suppressed.

In cases in which forming is performed with a gap between the pad 42 and the die 41 at the portion corresponding to the top plate section 20*a* of less than the plate thickness of the blank 30Y, excessive surface pressure acts between the blank 30Y and the die 41, such that the blank 30Y cannot slide (move in-plane) sufficiently in the die 41, leading to cracking of the flange section 20*d*.

However, in cases in which forming is performed with the gap between the pad 42 and the die 41 at the portion corresponding to the top plate section 20*a* maintained at 1.1 times the plate thickness of the blank 30Y or greater, out-of-plane deformation of the blank 30Y is not sufficiently restricted during pressing, and as forming progresses, not only does obvious creasing occur in the top plate section 20*a* due to far too much of the blank 30Y remaining at the top plate section 20*a*, but buckling also occurs, such that forming into a specific shape can no longer be achieved.

In cases in which a portion of a metal plate having a tensile strength of from 200 MPa to 1600 MPa, such as is generally employed in automobile components and the like, is formed in a state in which a gap between the pad 42 and the die 41 is maintained at greater than 1.0 times the plate thickness of the blank 30Y and up to 1.1 times plate thickness of the blank 30Y, at a portion of the pad 42 that is in the vicinity of, or in contact with, the out-of-plane deformation suppression region, as the out-of-plane deformation suppression region (region F), the gap between the pad 42 and the die 41 is more preferably set at from the plate thickness to 1.03 times the plate thickness since slight creasing occurs when the gap between the pad 42 and the die 41 is 1.03 times the plate thickness of the blank 30Y or greater.

In the manufacturing method according to the present exemplary embodiment, as illustrated in FIG. 6A and FIG. 6B, the vertical wall sections 20*c*, 20*c* and the flange sections 20*d*, 20*d* are formed at the position of the cross-section on line a-a by placing the portion that will form the top plate section 20*a* (see the portion 30*a* that will form the top plate section 20*a* in FIG. 3) on the die 41, and placing the pad 42 so as to hold down or be in the vicinity of this portion while pressing both sides of the blank 30 with the bending mold 43. When this is performed, as illustrated in FIG. 6C and FIG. 6D, the vertical wall section 20*c* and the flange section 20*d* are formed at the position of the cross-section on line b-b by placing a portion corresponding to the out-of-plane deformation suppression region F on the die 41, and pressing only one side of the blank 30 with the bending mold 43.

In this manner, at the cross-section on line b-b, only one side of the out-of-plane deformation suppression region F is press formed by the bending mold 43, and since the blank 30Y is placed between the pad 42 and the die 41 so as to be capable of moving, a sufficient amount of the blank flows into the mold.

In the above explanation of the free bending method, a gap is provided between the pad 42 and the die 41. However, the pad 42 may also apply pressure to the blank 30Y.

Namely, when forming the vertical wall section 20*c* and the flange section 20*d*, the pad 42 may apply pressure to a portion of the blank 30Y serving as the out-of-plane deformation suppression region (region F) with a specific load pressure.

Cracking occurs in the flange section 20*d* in cases in which, for example, the pad load pressure is set high, and, during pressing of the blank 30Y, the portion where the die mold 41 contacts the top plate section 20*a* is unable to slide (move in-plane) sufficiently between the die 41 and the pad 42.

Creasing occurs in the top plate section 20*a* in cases in which the load pressure of the pad 42 is set low, and, during pressing of the blank 30Y, out-of-plane deformation cannot be restricted at the portion where the die 41 contacts the top plate section 20*a*.

In cases in which a steel plate having a tensile strength of from 200 MPa to 1600 MPa, such as is generally employed in automobile components and the like, is formed, if the blank 30Y is applied with pressure by the pad 42 at a pressure of 30 MPa or greater, cracking occurs in the flange section 20*d* due to the blank being unable to slide (move) sufficiently above the location of the die 41 corresponding to the top plate section 20*a*. On the other hand, if pressure of 0.1 MPa or lower is applied then out-of-plane deformation cannot be sufficiently suppressed at the top plate section 20*a*. It is therefore desirable that the pressure applied to the blank 30Y by the pad 42 is from 1 MPa to 30 MPa.

Moreover, when the presses and mold units generally employed in automobile component manufacture are considered, at 0.4 MPa or lower, stable pressure application with the pad 42 using a gas cushion or the like becomes difficult, due to this being a small load, and at 15 MPa or greater, high pressure press equipment that pushes up the facility cost is required, due to this being a large load. It is therefore desirable that pressure application by the pad 42 is performed at a pressure of from 0.4 MPa to 15 MPa.

Here, pressure refers to the average surface pressure when the pressing force applied by the pad is divided by the surface area of the contact portion between the pad 42 and the blank 30Y, and a certain amount of localized variation may be present.

FIG. 7 is an explanatory diagram in which the out-of-plane deformation suppression region (region F) of the blank 30Y is illustrated by hatching.

As illustrated in FIG. 7, when forming the vertical wall section 20*c* and the flange section 20*d*, in plan view of the top plate section 20*a*, out of regions of the top plate section 20*a* divided into two by the tangent to the boundary line between the ridge line section 20*b* and the top plate section 20*a* at the end portion A (first end portion), this being the one end portion of the arc shaped curving locations 20*b* of the ridge line section 20*b*, the region on the side including the end portion B (second end portion), this being the other end portion, that is the region that contacts the top plate face of the die 41 (the face of the blank 30 corresponding to the portion 30*a* that will form the top plate section 20*a*) (the hatched portion in FIG. 7) is preferably applied with pressure as the out-of-plane deformation suppression region (region F). This thereby enables creasing to be suppressed from occurring in the top plate section 20*a* and the vertical wall section 20*c*.

When applying pad pressure, the pad employed preferably has a shape covering the entire portion of the blank 30 that contacts the top plate face of the die 41, or with a shape that covers part of the portion of the blank 30 that contacts the top plate face of the die 41 and includes the entire out-of-plane deformation suppression region (region F). However, for example in cases in which an additional shape has been added to the out-of-plane deformation suppression region (region F) according to the design of the product, a pad may be employed with a shape that avoids the additional shape portions, that at least includes a region of the out-of-plane deformation suppression region (region F) that extends up to at least 5 mm from the position that will form the outer edge portion 24*a* (the curved-line outer edge portion 24*a*2, the straight-line outer edge portion 24*a*3), and that covers 50% or greater of the surface area of the out-of-plane deformation suppression region (region F). A pad with a segmented pressure application face may also be employed.

In the blank 30, the region that will form the top plate section 20*a* and that extends up to at least 5 mm from the position that will form the outer edge portion 24*a* is preferably applied with pressure by the pad 42. Namely, the curved vertical wall portion 20*c*2 and the curved-line flange portion 20*d*2 are preferably formed by placing a region that is on the inside of the portion 30*a* of the blank 30 that will form the top plate section 20*a* and that extends up to at least 5 mm from the position that will form the outer edge portion 24*a*, in the vicinity of, or in contact with, the pad 42. For example, creasing is liable to occur in the top plate section 20*a* if the pad 42 only applies pressure to a region that extends up to at least 4 mm from the outer edge portion 24*a*.

Figure 8:
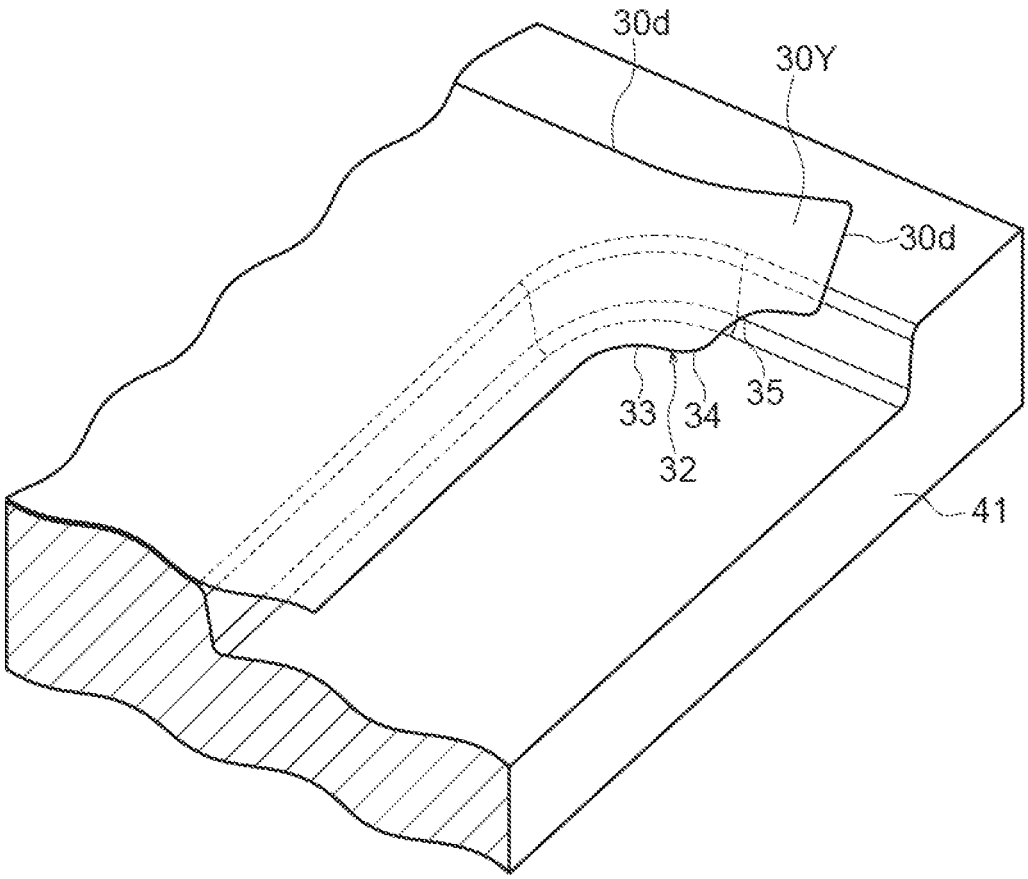
FIG. 8 is a perspective view illustrating a state in which a blank has been placed on a die.
Figure 9:
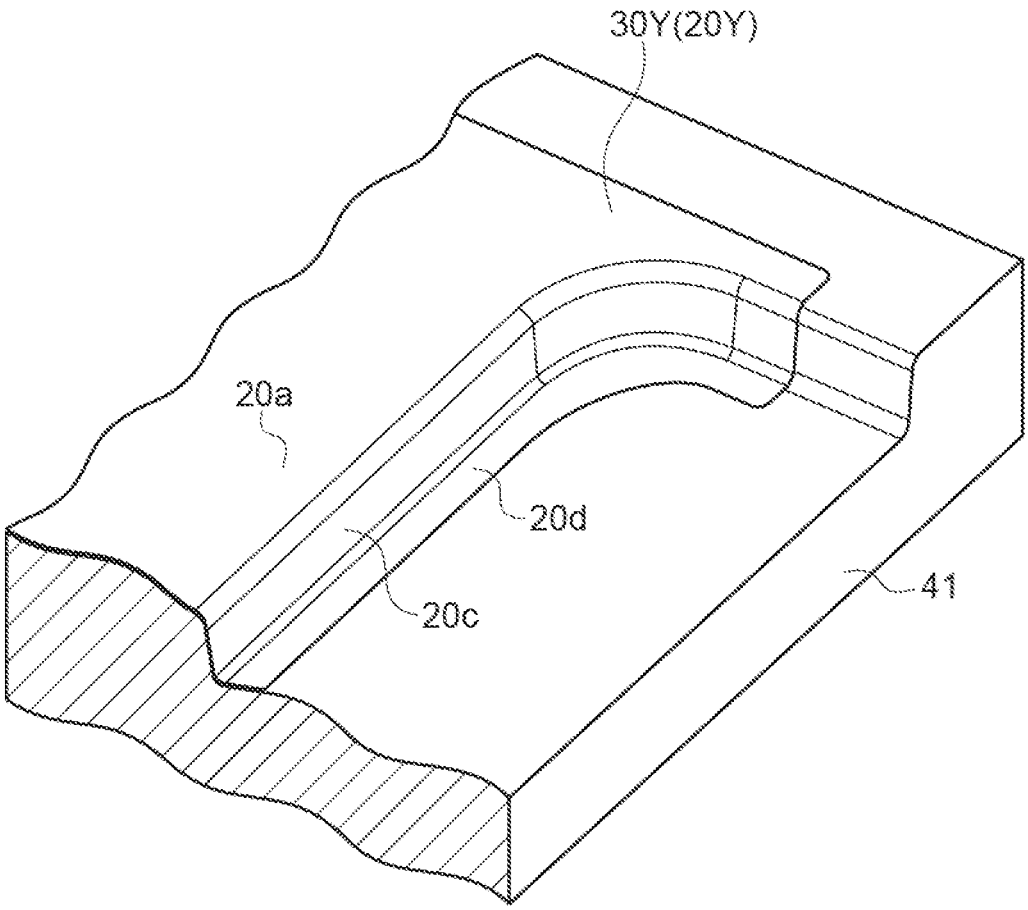
FIG. 9 is a perspective view illustrating a state after the blank has been formed into an L-shaped profile member.

FIG. 8 is a perspective view illustrating a state in which the blank 30Y has been placed on the die 41. FIG. 9 is a perspective view illustrating a state after the blank 30Y has been formed into the L-shaped profile member 20Y.

In the manufacturing method according to the present invention, as illustrated in FIG. 8, the blank 30Y is placed on the die 41, and, in a state in which the portion 30*a* that will form the top plate section 20*a* of the L-shaped profile member 20Y is applied with pressure toward the die 41 by the pad 42, the bending mold 43 is then lowered in the pressing direction, and the vertical wall sections 20*c*, 20*c* and the flange sections 20*d*, 20*d* are formed as illustrated in FIG. 9.

As described above, the blank 30 is deformed so as to follow the shape of the vertical wall section 20*c* and the flange section 20*d* by lowering the bending mold 43 in the pressing direction. When this is performed, a location of the blank 30 corresponding to the end portion 30*d* flows into the vertical wall section 20*c*. Namely, due to the position on the blank 30 of the end portion 30*d* that will form the flange section 20*d* straightening out, the occurrence of creasing in the top plate section 20*a*, arising in conventional drawing due to too much of the blank 30 flowing into the mold, is suppressed. Moreover, due to the position on the blank 30 of the end portion 30*d* corresponding to the flange section 20*d* not undergoing excessive stretching, the occurrence of cracking in the flange section 20*d*, which is vulnerable to cracking due to a reduction in plate thickness in conventional drawing, is suppressed. Due to being able to suppress the occurrence of creasing and cracking in this manner, there is no need to provide a large trim region in the vicinity of the end portion 30*d* of the blank 30, which is needed in order to prevent creasing in conventional methods.

The press formed article manufacturing method according to the present exemplary embodiment is a method for manufacturing from the blank 30 by cold pressing using the above free bending method.

Accordingly, applying the blank 30 in place of the blank 30Y results in obtaining the following operation in addition to exhibiting operation and advantageous effects similar to those of the free bending method described above.

In this manufacturing method, when performing pressing by bending, the blank 30 includes the first recess 33, the protrusion 34, and the second recess 35 at the edge portion of the excess portion 32, thereby increasing the amount of the blank that flows into the mold from the protrusion 34 provided to the excess portion 32, and enabling the occurrence of flange cracking to be suppressed. Both the first recess 33 and the second recess 35 that are respectively provided on either side of the protrusion 34 in the excess portion 32 straighten out during pressing, thereby enabling a reduction in the amount of displacement from the portion 30*a* that will form the top plate section 20*a* toward the vertical wall section 30*c*, and enabling cracking at the top plate edge to be suppressed from occurring.

In this manufacturing method, the blank 30 employed in pressing using such bending includes the first recess 33, the protrusion 34, and the second recess 35 at the edge portion of the excess portion 32, making it possible not only to suppress flange cracking from occurring using the protrusion 34 provided to the excess portion 32, but also enabling a reduction in the amount of displacement from the portion 30*a* that will form the top plate section 20*a* toward the vertical wall section 30*c* due to the first recess 33 and the second recess 35 provided to the excess portion both straightening out, thereby enabling the occurrence of top plate edge cracking to be suppressed, even in cases in which the L-shaped profile component 20 is set with a long width w3.

The following tests were performed in order to confirm the operation of the excess portion 32.

Namely, as illustrated in FIG. 10A to FIG. 10E, press formed articles 20 with the shape and dimensions illustrated in FIG. 1 and FIG. 2 were manufactured using the various shaped blanks 36 to 39, and 30 (Comparative Examples 1 to 4, Example) (tensile strength 1180 MPa, plate thickness 136 mm), by holding down the portion of the blank that will form the top plate section 20*a* with a pad, and then employing the free bending method to bend with a bending forming.

Note that the blanks 36 to 39, 30 are the same as each other, except for in the excess portion 32.

Figure 10A:
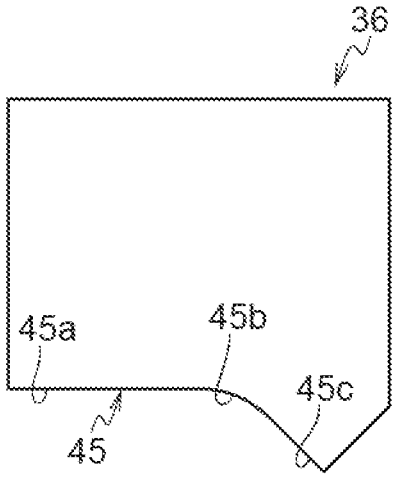
FIG. 10A is a schematic explanatory diagram illustrating the shape of a blank of a Comparative Example 1.
Figure 10B:
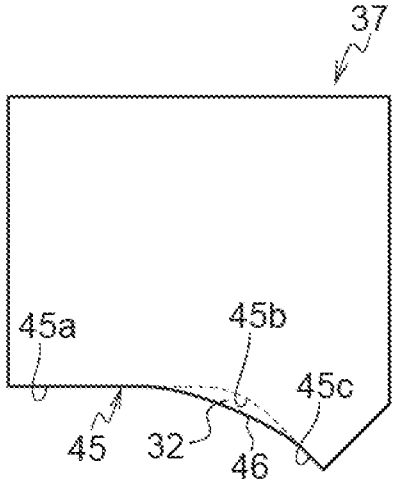
FIG. 10B is a schematic explanatory diagram illustrating the shape of a blank of a Comparative Example 2.
Figure 10C:
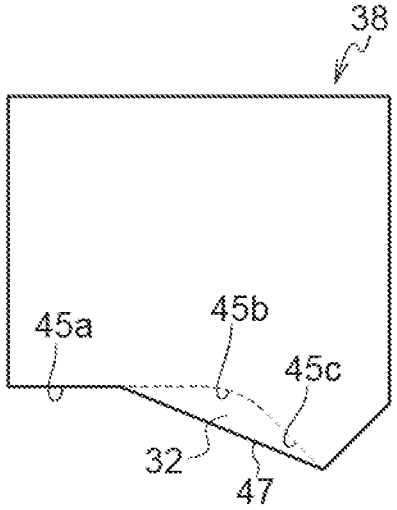
FIG. 10C is a schematic explanatory diagram illustrating the shape of a blank of a Comparative Example 3.
Figure 10D:
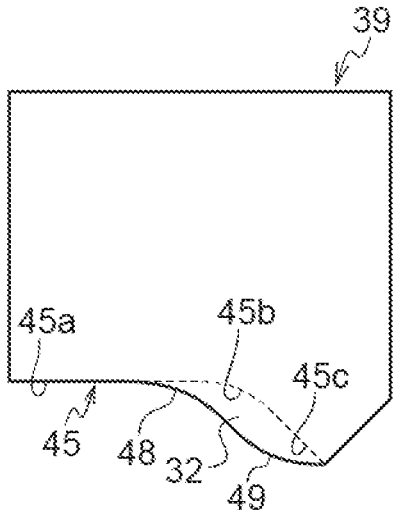
FIG. 10D is a schematic explanatory diagram illustrating the shape of a blank of a Comparative Example 4.
Figure 10E:
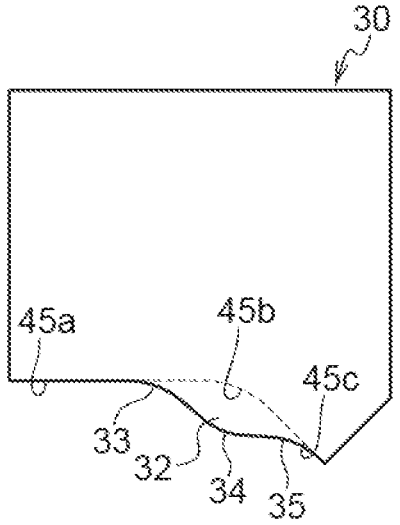
FIG. 10E is a schematic explanatory diagram illustrating the shape of a blank of an Example.

FIG. 10A illustrates the blank 36 (Comparative Example 1), this having an opened-out shape based on the L-shaped profile component 20. FIG. 10B to FIG. 10E each illustrates blanks in which an excess portion 32 is formed to the edge of the portion that will form the flange section 20*d*. FIG. 10B illustrates the blank 37 (Comparative Example 2), formed with a recess portion 46 with a curvature on the edge of the excess portion 32 having a negative sign (radius of curvature 300 mm) FIG. 10C illustrates the blank 38 (Comparative Example 3), in which the excess portion 32 is formed with a straight-line edge 47. FIG. 10D illustrates the blank 39 (Comparative Example 4) formed with a recess 48 and a protrusion 49, each having a radius of curvature of 150 mm, next to each other along the edge of the excess portion 32. FIG. 10E illustrates the blank 30 (the present Example) formed with the first recess 33, the protrusion 34, and the second recess 35, each having a radius of curvature of 100 mm, next to each other along the edge of the excess portion 32.

Table 1 illustrates the results of investigating the plate thickness reduction ratio and cracking in the portion A and in the portion B respectively in the press formed article 20 illustrated in FIG. 1. Note that the location A1 to the location A3 in Table 1 refer to the locations in FIG. 1.

TABLE 1

| Blank Shape | Comparative Example 1 (36) | Comparative Example 2 (37) | Comparative Example 3 (38) | Comparative Example 4 (39) | Example (30) |
|---|---|---|---|---|---|
| Cracking at edge location A1 | present | absent | absent | absent | absent |
| Cracking at die rounded location A2 | present | present | absent | absent | absent |
| Cracking at vertical wall location A3 | absent | absent | present | present | absent |
| Cracking at top plate edge location B | absent | absent | present | present | absent |

As illustrated in Table 1, flange cracking occurred at the portion A in the Comparative Example 1. It can be seen that although the plate thickness reduction ratio at the portion A decreases as the surface area provided for the excess portion 32 becomes larger, as in the Comparative Examples 2 to 4, and the risk of flange cracking at the portion A is lower, the plate thickness reduction ratio becomes larger at the portion B, and so the risk of top plate edge cracking at the portion B is higher.

On the other hand, in the Example of the present invention, not only can the smallest plate thickness reduction ratio at the portion A be achieved, but also the plate thickness reduction ratio at the portion B can also be kept smaller than in the blanks 38, 39 of the Comparative Examples 3 and 4. This thereby enables the occurrence of top plate edge cracking to be prevented at the portion B as well as preventing flange section edge cracking at portion A.

The blank 30 is formed into an intermediate pressed body by the free bending method in this manner. After performing further bending as required to the intermediate pressed body formed in this manner, trimming is performed to give the external profile the desired shape, and holes are formed to manufacture the pressed body product.

EXAMPLE

Figure 11:
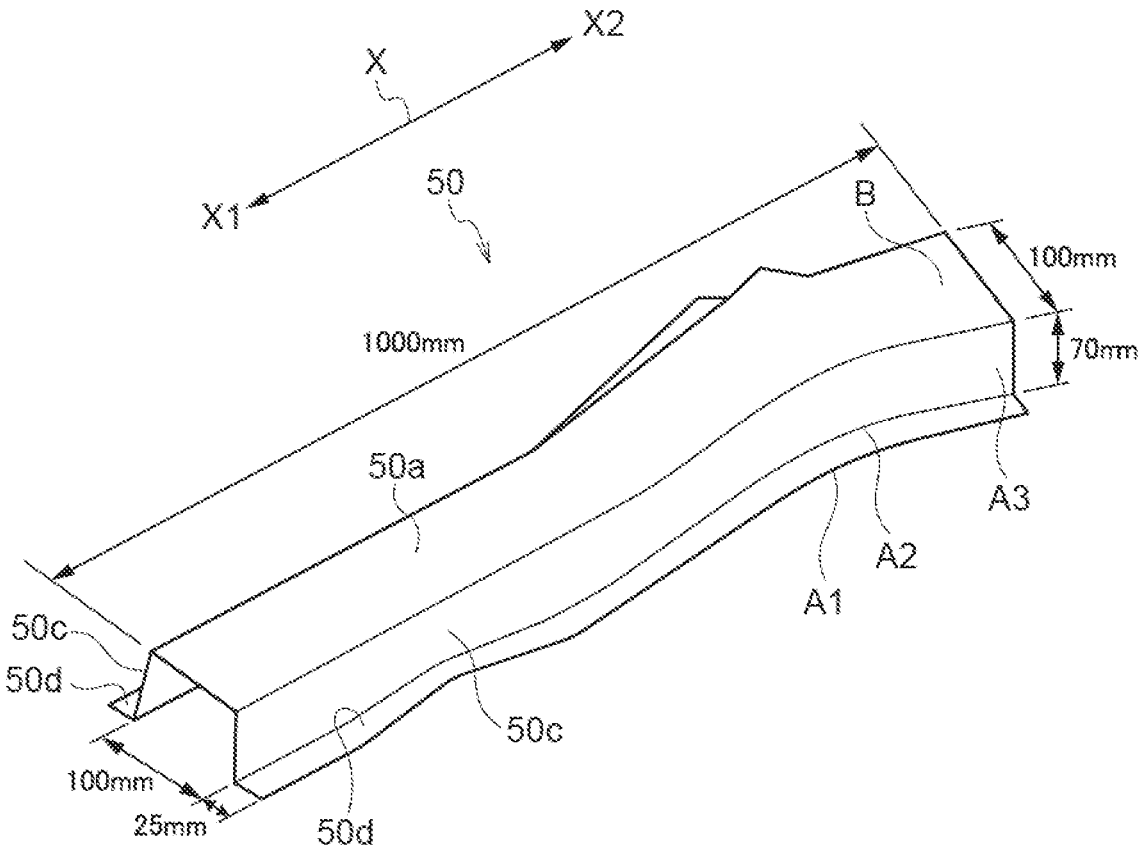
FIG. 11 is a perspective view illustrating shape of a press formed article that is a configuration component of a framework component of an automobile produced by the Example.
Figure 12:
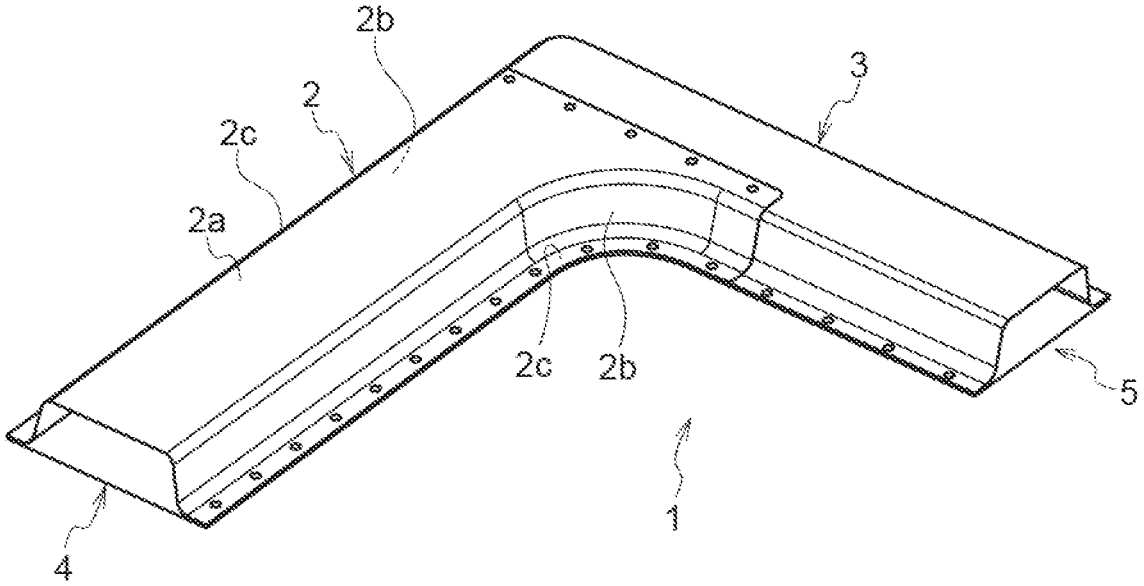
FIG. 12 is a schematic explanatory diagram illustrating an example of a framework member formed by joining configuration members together by spot welding.
Figure 13:
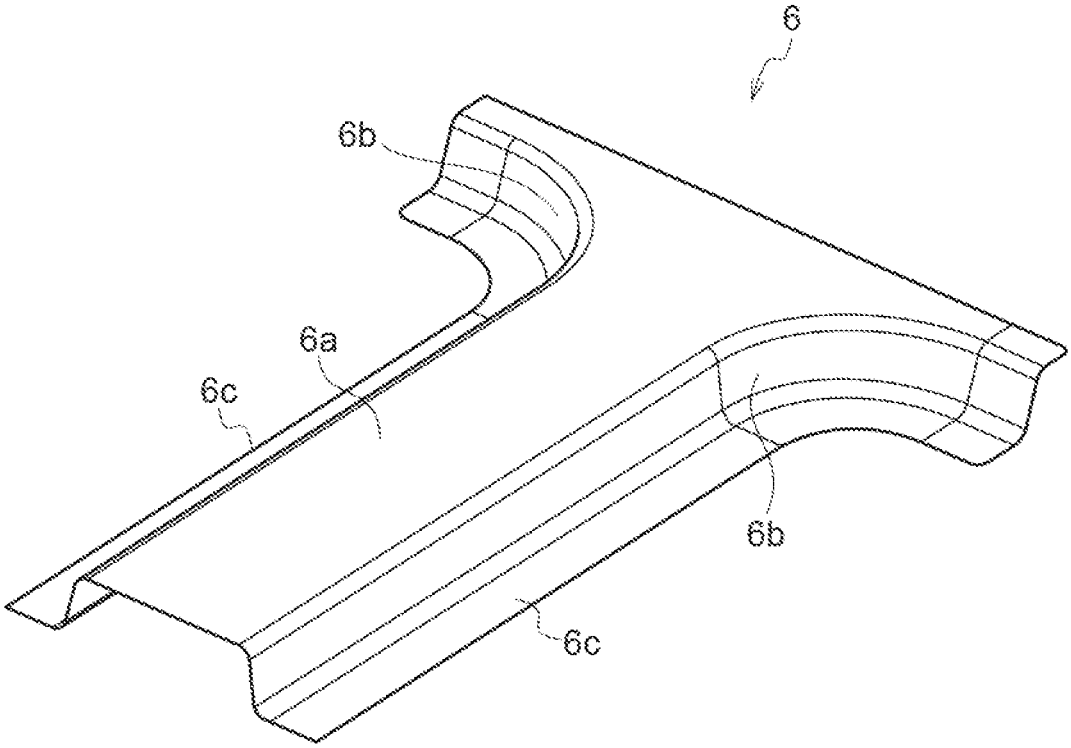
FIG. 13 is an explanatory diagram illustrating a T-shaped profile component in which a top plate section has a T-shaped external profile in plan view.
Figure 14B:
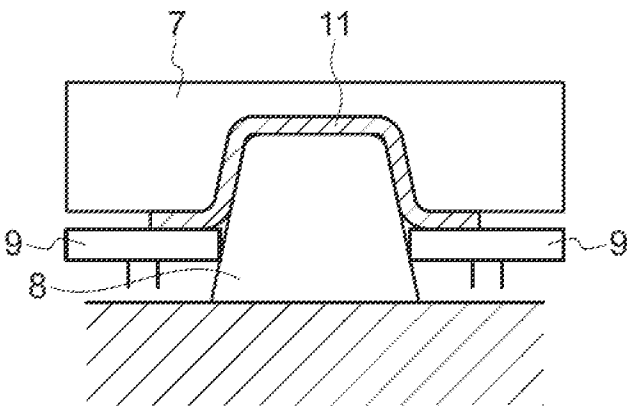
FIG. 14B is a schematic explanatory diagram illustrating pressing by drawing, upon completion of forming.
Figure 14A:
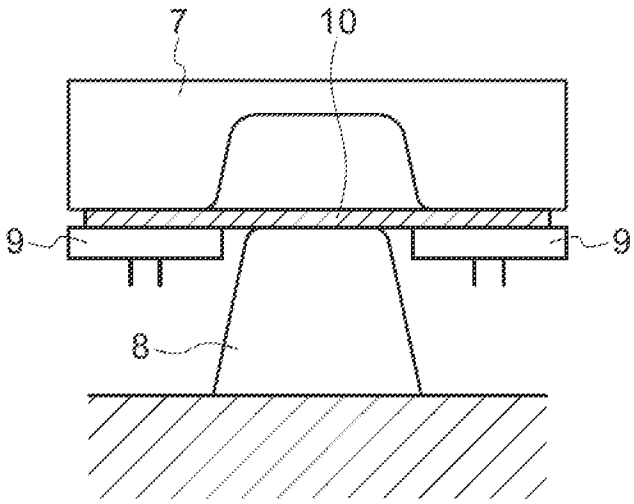
FIG. 14A is a schematic explanatory diagram illustrating pressing by drawing, prior to the start of forming.
Figure 15:
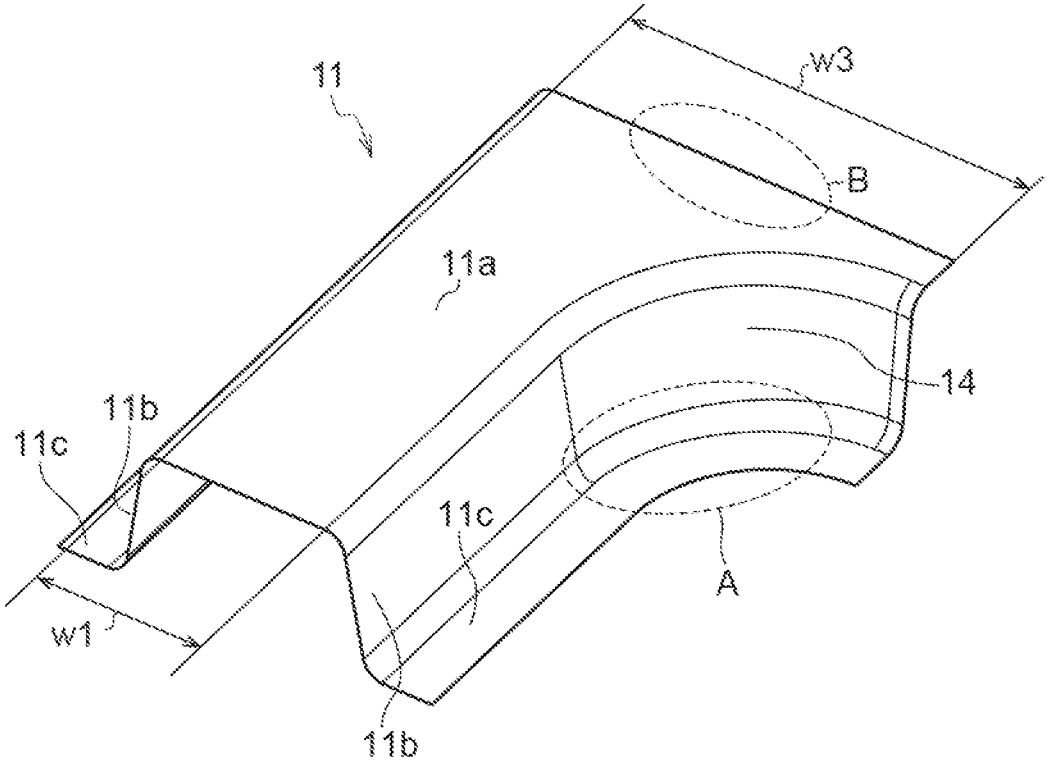
FIG. 15 is a schematic explanatory diagram illustrating an example of a press formed article manufactured by pressing by drawing.
Figure 16:
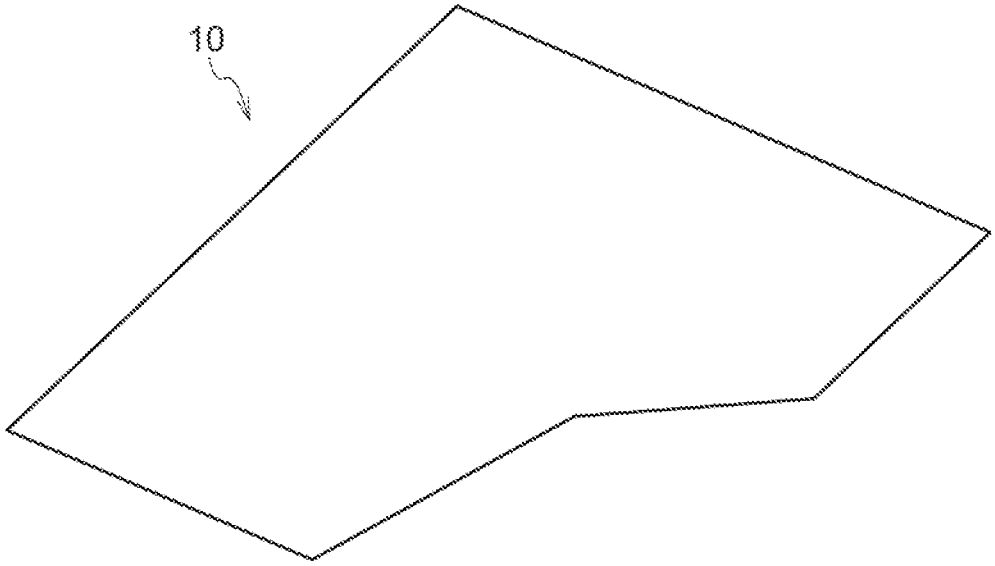
FIG. 16 is a perspective view illustrating a blank that is material for forming a press formed article.
Figure 17:
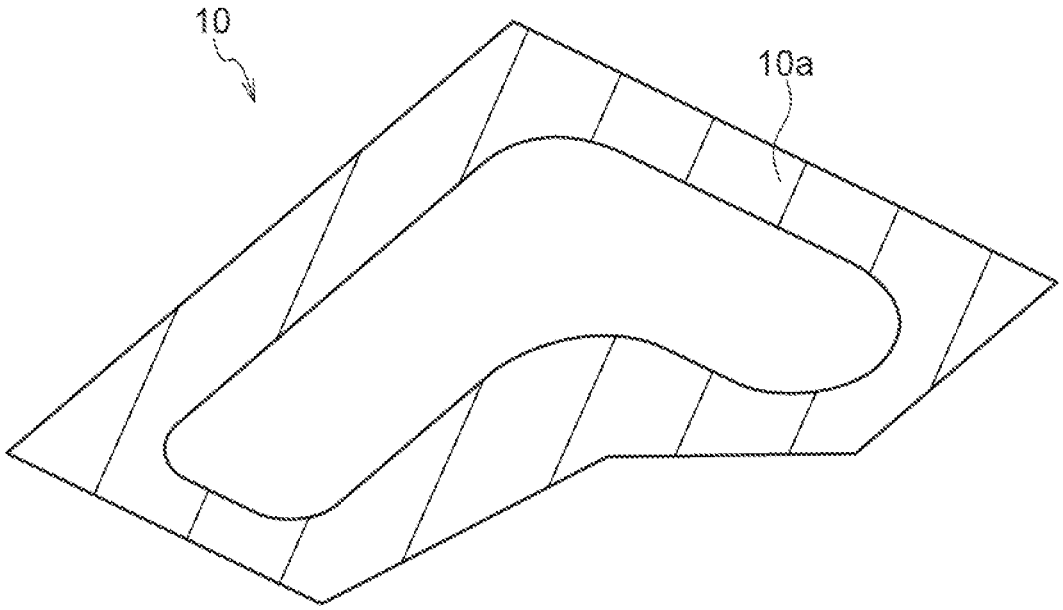
FIG. 17 is a schematic explanatory diagram in which a crease suppression region of a blank is illustrated by hatching.
Figure 18:
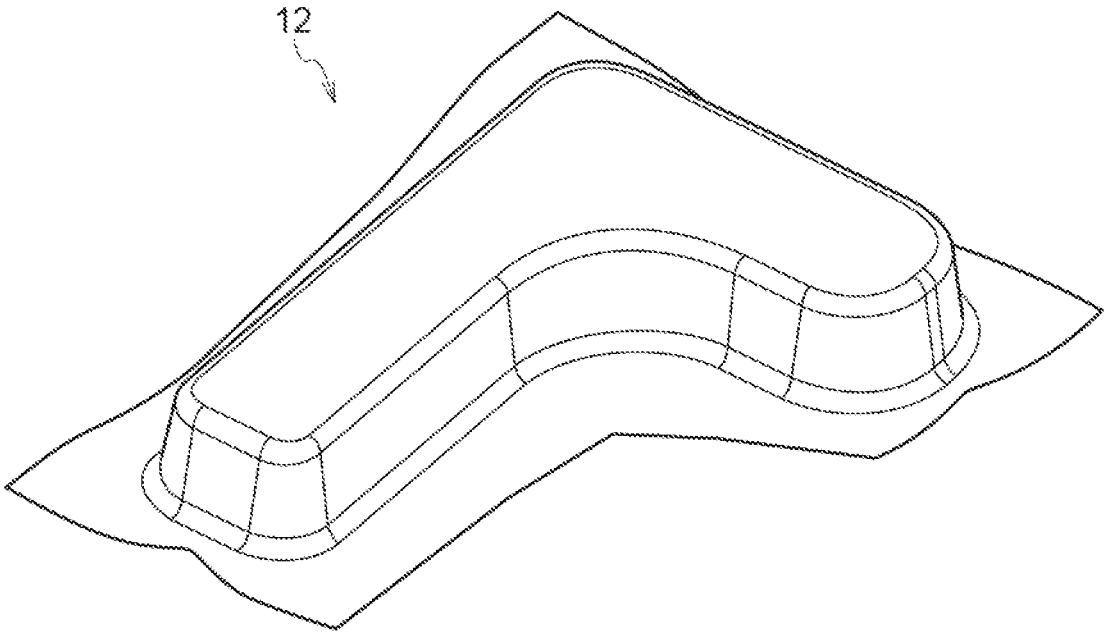
FIG. 18 is a perspective view illustrating an intermediate press formed article after pressing.
Figure 19:
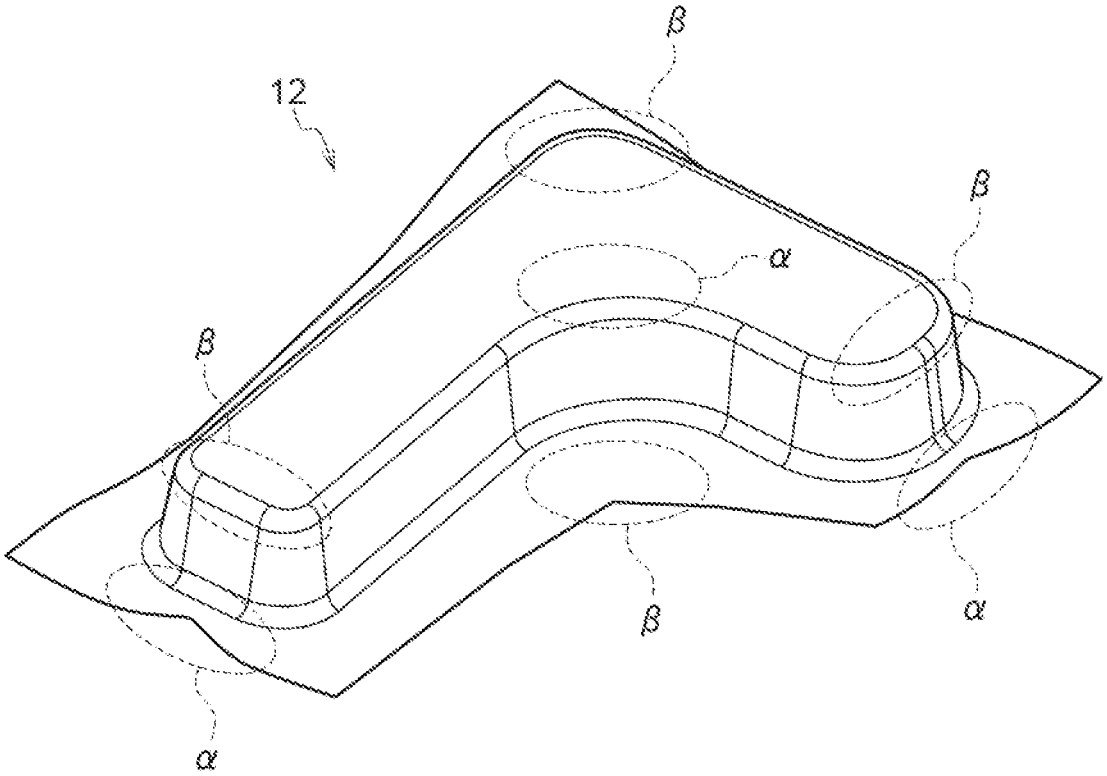
FIG. 19 is an explanatory diagram illustrating an example of conditions under which creasing and cracking occur in an intermediate press formed article when employing a free bending method.

FIG. 11 is a perspective view illustrating the shape of a press formed article 50, this being a configuration component of a vehicle framework component produced as a sample using the present Example.

As illustrated in FIG. 11, the press formed article 50 has an overall length of 1000 mm, and a top plate section 50*a* has a width of 100 mm at both the X1 direction and the X2 direction end portions, a height of a vertical wall section 50*c* of 70 mm, and a width of a flange section 50*d* of 25 mm.

Blanks for the press formed article 50 are formed from three types of high tensile steel plates, having respective tensile strengths of 590 MPa grade, 980 MPa grade, and 1180 MPa grade, and each having a plate thickness of 1.6 mm. In the opened-out shape of the press formed article, the excess portion 32 illustrated in FIG. 3 is formed to the edge of a portion that will form a curving portion of a flange, and the first recess 33, the protrusion 34, and the second recess 35 are provided to the edge of the excess portion 32.

The press formed article 50 illustrated in FIG. 11 is manufactured by employing the three types of blank with different strength levels, using the free bending method in which each blank is placed on a punch, and the portion that will form the top plate section is held down by a pad, before then bending using a die.

The results demonstrate that good pressing of the press formed article 50 according to the present invention illustrated in FIG. 11 could be achieved whichever of the 3 types of blank is employed, without flange cracking occurring at location A1, without cracking occurring at the die rounded location A2, without cracking occurring at the vertical wall location A3, and, moreover, without cracking occurring at the top plate edge location B.

The entire contents of the disclosure of Japanese Patent Application No. 2013-101419, filed May 13, 2013, are incorporated by reference in the present specification.

INDUSTRIAL APPLICABILITY

As described above, the present invention enables high quality and efficient forming with high strength steel plates and the like. The present invention has a high degree of applicability in steel plate processing technology industries, for example in the automotive industry.

The invention claimed is:

1. A flat plate shaped blank that is in an opened out shape, the flat plate shaped blank comprising:

an excess portion of the flat plate shaped blank in the opened out shape, and portions corresponding to a top plate section, a vertical wall section and a flange section, respectively, the flange section having a curved-line flange portion corresponding to a curved portion of the top plate section;

wherein the excess portion bulges out from the portion corresponding to the flange section and has a first recess and a second recess with a negative sign curvature on either side of a protrusion with a positive sign curvature when taking a curvature in a direction toward the inside of the flat plate shaped blank as having a negative sign and taking a curvature in the opposite direction to toward the inside of the flat plate shaped blank as having a positive sign, and bulges out from the portion corresponding to the flange section; and the protrusion is located in an outer edge of the curved-line flange portion.

2. The blank of claim 1, wherein the excess portion further comprises a straight-line portion forming a straight line in plan view at least one of between the first recess and the protrusion, or between the protrusion and the second recess.

3. A forming plate comprising the blank of claim 1, on which pre-processing has been performed prior to pressing.

4. A method of manufacturing method a press formed article, the method comprising:

placing the blank of claim 1, between a die, and a pad and a bending mold; and in a state in which a portion of the blank, or of the forming plate, that will form an end portion of the first section, a vertical wall section, and the second section is present in the same plane as a portion of the blank, or of the forming plate, that will form the first section, press forming the vertical wall section and the second section by bending while moving the end portion in-plane with respect to a location of the die corresponding to the first section, by relatively moving either the die or the bending mold in a direction so as to approach each other, in a state in which an out-of-plane deformation suppression region that is part of a portion of the blank, or of the forming plate, that will form the first section, is being applied with pressure by the pad.

5. A method of manufacturing a press formed article, the method comprising:

placing the blank of claim 1, between a die, and a pad, and a bending mold; and in a state in which a portion of the blank, or of the forming plate, that will form an end portion of the first section, the vertical wall section, and the second section, is present in the same plane as a portion of the blank, or of the forming plate, that will form the first section, pressing forming the vertical wall section and the second section by bending, by placing the pad in the vicinity of, or in contact with, an out-of-plane deformation suppression region that is part of a portion of the blank, or of the forming plate, that will form the first section, and relatively moving either the die, or the bending mold, in a direction so as to approach each other while maintaining a gap between the pad and the die of from the plate thickness to 1.1 times the plate thickness of the blank, or of the forming plate.

6. The method of manufacturing a press formed article of claim 4, wherein, in plan view of the blank or the forming plate, the out-of-plane deformation suppression region is a region that is on a side of a location that will form the curved-line outer edge portion out of regions of the portion that will form the first section that are divided into two by an extension line of a line that will form the straight-line outer edge portion, and that is a region that contacts the die.

7. The method of manufacturing a press formed article of claim 4, wherein a portion that is an end portion of the blank, or of the forming plate, and that is present further toward a side that will form the first section than the curved-line outer edge portion out of locations corresponding to the out-of-plane deformation suppression region of the blank, or of the forming plate, is present in the same plane as a portion that will form the first section.

8. The method of manufacturing a press formed article of claim 4, wherein the height of the vertical wall section is either 0.2 times the length of the curved-line outer edge portion or greater, or 20 mm or greater.

9. The method of manufacturing a press formed article of claim 4, wherein the vertical wall section and the second section are formed by placing the pad in the vicinity of, or in contact with, a region that is inside a portion of the blank, or of the forming plate, that will form the first section, and that is a region that extends up to at least 5 mm from the curved-line outer edge portion toward the side that will form the first section.

10. The method of manufacturing a press formed article of claim 4, wherein the width of the second section, from a central position of the curved-line outer edge portion to a position separated by 50 mm or greater from an end portion of the curved-line outer edge portion toward the straight-line outer edge portion side, is from 25 mm to 100 mm.

11. The method of manufacturing a press formed article of claim 4, wherein the maximum radius of curvature of the curved-line outer edge portion of the first section is from 5 mm to 300 mm.

12. The method of manufacturing a press formed article of claim 4, wherein the tensile strength of the blank, or of the forming plate, is from 400 MPa to 1600 MPa.

13. The blank of claim 1, wherein a first section is to be formed into a top plate section, a second section is to be formed into a vertical wall section and a flange section, the edge of the second section is to be an edge of the flange section, and the excess portion bulges out from the edge of the flange section.

* * * * *